US011066268B2

(12) United States Patent
Shibasaki et al.

(10) Patent No.: US 11,066,268 B2
(45) Date of Patent: Jul. 20, 2021

(54) BINDING DEVICE, POST-PROCESSING APPARATUS, AND IMAGE FORMING SYSTEM

(71) Applicants: Yuusuke Shibasaki, Kanagawa (JP); Kei Sasaki, Kanagawa (JP); Junya Suzuki, Kanagawa (JP); Koji Furuta, Kanagawa (JP); Yasuo Niikura, Kanagawa (JP); Kazuki Mishina, Kanagawa (JP); Kenji Hari, Kanagawa (JP); Yuuta Mori, Kanagawa (JP); Hisayoshi Sugawara, Kanagawa (JP)

(72) Inventors: Yuusuke Shibasaki, Kanagawa (JP); Kei Sasaki, Kanagawa (JP); Junya Suzuki, Kanagawa (JP); Koji Furuta, Kanagawa (JP); Yasuo Niikura, Kanagawa (JP); Kazuki Mishina, Kanagawa (JP); Kenji Hari, Kanagawa (JP); Yuuta Mori, Kanagawa (JP); Hisayoshi Sugawara, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/811,100

(22) Filed: Mar. 6, 2020

(65) Prior Publication Data

US 2020/0307944 A1 Oct. 1, 2020

(30) Foreign Application Priority Data

Mar. 26, 2019 (JP) ..... JP2019-059089

(51) Int. Cl.
*B65H 37/04* (2006.01)
*B65H 31/34* (2006.01)

(52) U.S. Cl.
CPC ..... *B65H 37/04* (2013.01); *B65H 31/34* (2013.01); *B65H 2511/13* (2013.01); *B65H 2801/27* (2013.01)

(58) Field of Classification Search
CPC ..... B65H 9/101; B65H 31/26; B65H 31/34; B65H 2301/362; B65H 2301/4222;
(Continued)

(56) References Cited

U.S. PATENT DOCUMENTS 6,290,220 B1 * 9/2001 Takehara ..... B42C 1/12 270/58.08
7,434,796 B2 * 10/2008 Kushida ..... B42B 4/00 270/58.08

(Continued)

FOREIGN PATENT DOCUMENTS

JP 8-099761 4/1996
JP 2007-161472 6/2007

*Primary Examiner* — Leslie A Nicholson, III
(74) *Attorney, Agent, or Firm* — Harness, Dickey & Pierce. P.L.C.

(57) ABSTRACT

A binding device includes a stacking device configured to receive sheets, a sheet alignment member configured to align the sheets on the stacking device, a binder configured to bind the sheets on the stacking device, a binder moving device configured to move the binder, and a retreat device configured to retreat the sheet alignment member from a range of movement of the binder. The retreat device retreats the sheet alignment member in response to a pressing force acting on the sheet alignment member in a direction of movement of the binder.

7 Claims, 28 Drawing Sheets

(58) Field of Classification Search
CPC ..... B65H 2301/4223; B65H 2511/13; B65H 37/04; B65H 2801/27
USPC ..... 270/58.12, 58.17, 58.27
See application file for complete search history.

(56) References Cited

U.S. PATENT DOCUMENTS

| | | | | |
|---|---|---|---|---|
| 7,597,312 | B2 * | 10/2009 | Nishioka | B42C 1/12 270/58.07 |
| 7,681,873 | B2 * | 3/2010 | Tsutsui | B65H 37/04 270/58.08 |
| 7,699,302 | B2 * | 4/2010 | Ichikawa | B42C 1/12 270/58.12 |
| 7,731,169 | B2 * | 6/2010 | Saito | B65H 31/26 270/58.12 |
| 7,866,648 | B2 * | 1/2011 | Noh | G03G 15/6544 270/58.12 |
| 2007/0147925 | A1 | 6/2007 | Nomura et al. | |
| 2007/0176357 | A1 | 8/2007 | Horio et al. | |
| 2009/0152792 | A1 | 6/2009 | Katoh et al. | |
| 2012/0083400 | A1 | 4/2012 | Shibasaki et al. | |
| 2012/0086161 | A1 | 4/2012 | Nagasako et al. | |
| 2012/0153556 | A1 | 6/2012 | Sugiyama et al. | |
| 2012/0267846 | A1 | 10/2012 | Nakada et al. | |
| 2012/0282004 | A1 | 11/2012 | Furuhashi et al. | |
| 2012/0294695 | A1 | 11/2012 | Sasaki et al. | |
| 2013/0001848 | A1 | 1/2013 | Hidaka et al. | |
| 2013/0001849 | A1 | 1/2013 | Suzuki et al. | |
| 2013/0113154 | A1 | 5/2013 | Furuhashi et al. | |
| 2013/0134659 | A1 | 5/2013 | Konno et al. | |
| 2013/0147105 | A1 | 6/2013 | Sugiyama et al. | |
| 2013/0228965 | A1 | 9/2013 | Hoshino et al. | |
| 2013/0236228 | A1 | 9/2013 | Nagasako et al. | |
| 2013/0264762 | A1 | 10/2013 | Matsushita et al. | |
| 2013/0270762 | A1 | 10/2013 | Saitoh et al. | |
| 2013/0270763 | A1 | 10/2013 | Furuhashi et al. | |
| 2013/0300050 | A1 | 11/2013 | Suzuki et al. | |
| 2014/0011656 | A1 | 1/2014 | Niikura et al. | |
| 2014/0062003 | A1 | 3/2014 | Niitsuma et al. | |
| 2014/0062005 | A1 | 3/2014 | Suzuki et al. | |
| 2014/0062016 | A1 | 3/2014 | Watanabe et al. | |
| 2014/0138896 | A1 | 5/2014 | Yoshida et al. | |
| 2014/0145395 | A1 | 5/2014 | Takano et al. | |
| 2014/0151951 | A1 | 6/2014 | Shibasaki et al. | |
| 2014/0159301 | A1 | 6/2014 | Suzuki et al. | |
| 2014/0203501 | A1 | 7/2014 | Hoshino et al. | |
| 2014/0219747 | A1 | 8/2014 | Takahashi et al. | |
| 2015/0003938 | A1 | 1/2015 | Morinaga et al. | |
| 2015/0028540 | A1 | 1/2015 | Shibasaki et al. | |
| 2015/0030414 | A1 | 1/2015 | Takahashi et al. | |
| 2015/0076759 | A1 | 3/2015 | Kosuge et al. | |
| 2015/0091246 | A1 | 4/2015 | Yoshida et al. | |
| 2015/0123342 | A1 | 5/2015 | Furuhashi et al. | |
| 2015/0166280 | A1 | 6/2015 | Hino et al. | |
| 2015/0225191 | A1 | 8/2015 | Niikura et al. | |
| 2015/0253716 | A1 | 9/2015 | Nagasako et al. | |
| 2015/0321872 | A1 | 11/2015 | Hari et al. | |
| 2015/0353315 | A1 | 12/2015 | Suzuki et al. | |
| 2015/0360899 | A1 | 12/2015 | Takahashi et al. | |
| 2016/0016740 | A1 | 1/2016 | Niikura et al. | |
| 2016/0107853 | A1 | 4/2016 | Hashimoto et al. | |
| 2016/0107854 | A1 | 4/2016 | Hashimoto et al. | |
| 2016/0122144 | A1 | 5/2016 | Fukumoto et al. | |
| 2016/0185552 | A1 | 6/2016 | Hoshino et al. | |
| 2016/0264370 | A1 | 9/2016 | Okutsu et al. | |
| 2016/0272443 | A1 | 9/2016 | Seto et al. | |
| 2016/0340144 | A1 | 11/2016 | Sakano et al. | |
| 2016/0340145 | A1 | 11/2016 | Kunieda et al. | |
| 2016/0360053 | A1 | 12/2016 | Suzuki et al. | |
| 2017/0081140 | A1 | 3/2017 | Fukumoto et al. | |
| 2017/0174453 | A1 | 6/2017 | Akai et al. | |
| 2017/0174454 | A1 | 6/2017 | Matsuoka et al. | |
| 2017/0174458 | A1 | 6/2017 | Takano et al. | |
| 2017/0174462 | A1 | 6/2017 | Edo et al. | |
| 2017/0174465 | A1 | 6/2017 | Morinaga et al. | |
| 2017/0203935 | A1 | 7/2017 | Hari et al. | |
| 2017/0217239 | A1 | 8/2017 | Suzuki et al. | |
| 2017/0305706 | A1 | 10/2017 | Takahashi et al. | |
| 2018/0148286 | A1 | 5/2018 | Hari et al. | |
| 2018/0251332 | A1 | 9/2018 | Hari et al. | |
| 2018/0259895 | A1 | 9/2018 | Shibasaki et al. | |
| 2018/0346265 | A1 | 12/2018 | Niikura | |

* cited by examiner

BINDING DEVICE, POST-PROCESSING APPARATUS, AND IMAGE FORMING SYSTEM

CROSS-REFERENCE TO RELATED APPLICATIONS

This patent application is based on and claims priority pursuant to 35 U.S.C. § 119(a) to Japanese Patent Application No. 2019-059089, filed on Mar. 26, 2019, in the Japan Patent Office, the entire disclosure of which is incorporated by reference herein.

BACKGROUND

Technical Field

The present disclosure relates to a binding device, a post-processing apparatus, and an image forming system.

Related Art

A post-processing apparatus these days is coupled as part of an image forming system to an image forming apparatus, and performs as post-processing on a sheet onto which an image has been formed and output by the image forming apparatus. A known type of a post-processing apparatus is a binding device that binds a plurality of sheets.

A binding device includes: a stacking device that stacks sheets conveyed from an image forming apparatus, to form a sheet bundle; an alignment device that aligns an end portion of the sheet bundle; and a binder that performs a binding process on the end portion of the sheet bundle at a predetermined position.

As the binder performs a binding process along an edge of a sheet bundle at a predetermined binding position, the binder moves along the edge. Meanwhile, the alignment device aligns the edge of the sheet bundle, and therefore, is disposed near the edge of the sheet bundle. In this arrangement, the alignment device is located in the path through which the binder moves. Due to such positional relations, the binder may interfere with the alignment device while moving.

SUMMARY

According to an embodiment of the present disclosure, a binding device includes a stacking device configured to receive sheets, a sheet alignment member configured to align the sheets on the stacking device, a binder configured to bind the sheets on the stacking device, a binder moving device configured to move the binder, and a retreat device configured to retreat the sheet alignment member from a range of movement of the binder. The retreat device retreats the sheet alignment member in response to a pressing force acting on the sheet alignment member in a direction of movement of the binder.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
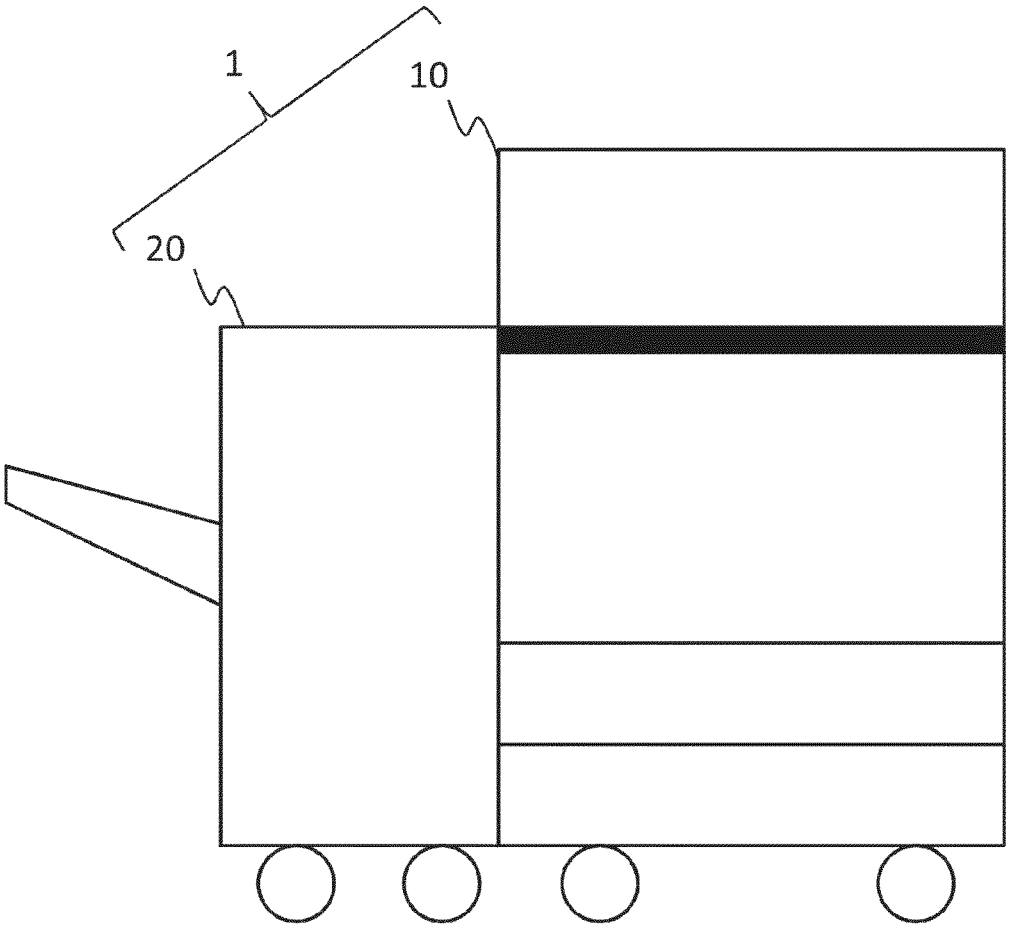
FIG. 1 is a diagram illustrating the configuration of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below in the drawings for explaining the following embodiments, the same reference codes are allocated to elements (members or components) having the same function or shape and redundant descriptions thereof are omitted below.

The following is a description of embodiments of a binding device, a post-processing apparatus, and an image forming system according to the present disclosure, with reference to the accompanying drawings.

Image Forming System

FIG. 1 is a diagram schematically illustrating the configuration of a printing system 1 that is an embodiment of an image forming system. The printing system 1 illustrated in FIG. 1 includes: a printer 10 as an image forming apparatus that prints an image on a sheet-like recording medium; and a post-processing apparatus 20 that is coupled to the printer 10, and performs predetermined post-processing on sheets on which printing has been performed.

The post-processing apparatus 20 includes various kinds of devices that perform a punching process for punching holes, an end binding process for binding sheets at an end, a saddle stitching process for performing saddle stitching, and the like on sheets on which printing has been performed.

General Configuration of the Post-Processing Apparatus

Figure 2:
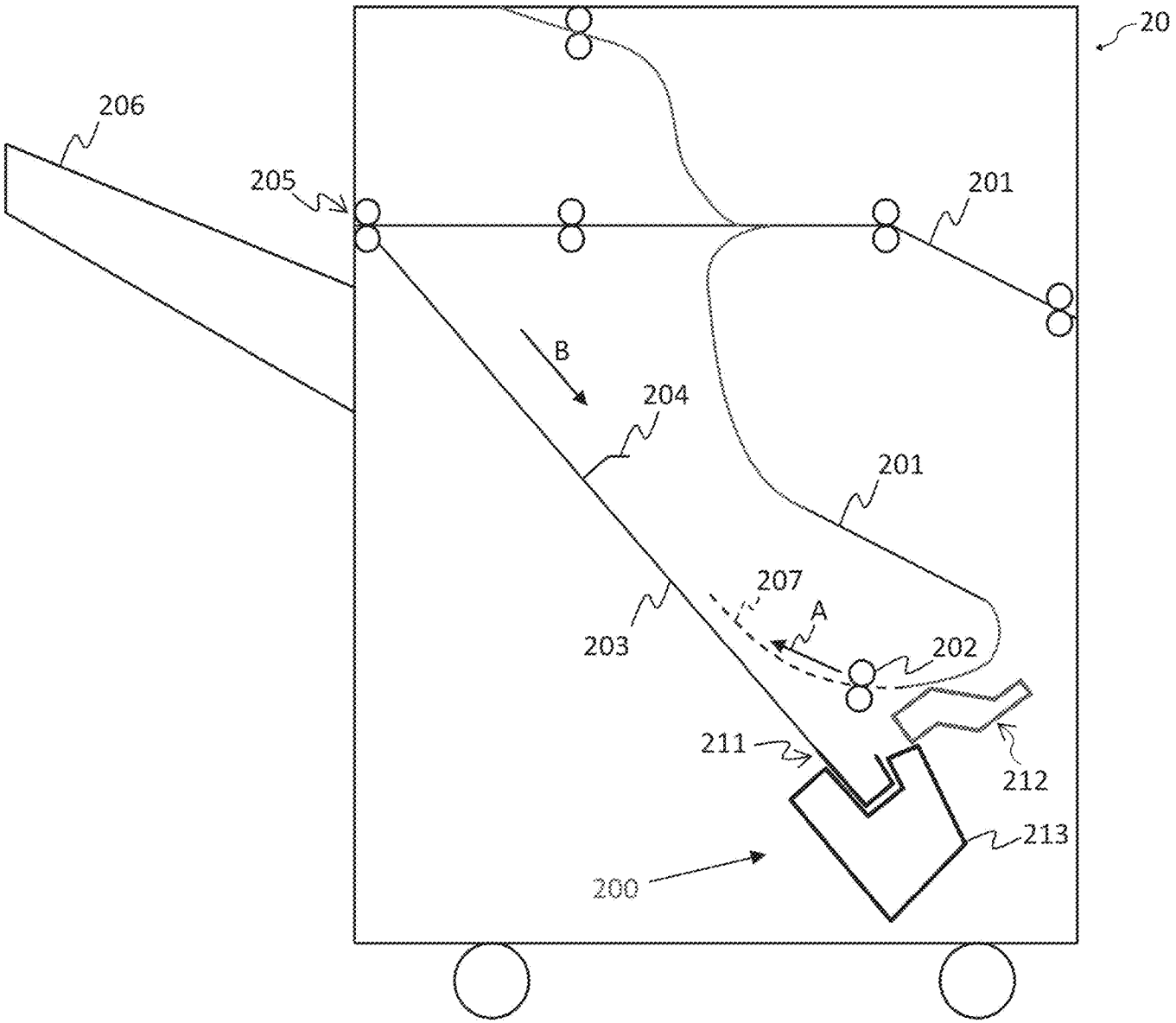
FIG. 2 is a diagram illustrating the configuration of a post-processing apparatus according to an embodiment of the present disclosure.

Referring now to FIG. 2, the general configuration of the post-processing apparatus 20 is described. As illustrated in FIG. 2, the post-processing apparatus 20 includes an introduction passage 201 coupled to the printer 10, internal ejection rollers 202, a staple tray 203, a tip tapping member 204, external ejection rollers 205, a sheet catch tray 206, reference fences 211, rear end pressing members 212, and a side stapler 213.

The introduction passage 201 introduces a paper sheet 207 (hereinafter referred to as the sheet 207) as a printed sheet ejected from the printer 10 as the apparatus in the previous stage into the post-processing apparatus 20, and forms a conveyance path for conveying the sheet 207 to a side binding device 200 described later.

The internal ejection rollers 202 are disposed at the end of the introduction passage 201, and eject the sheet 207 onto the staple tray 203.

The staple tray 203 is a primary stack tray that sequentially receives sheets 207 to form a bundle of sheets 207 (hereinafter referred to as a sheet bundle), and corresponds to a stacking device.

The tip tapping member 204 serving as a pressing member is an end position adjuster that regulates the position of the front end of a sheet 207 ejected in the direction of arrow A toward the staple tray 203 so that the rear end in the ejection direction comes into contact with the reference fences 211. The tip tapping member 204 operates so as to tap the top (in the direction of arrow A) of each of the sheets 207 stacked on the staple tray 203 in the direction of arrow 13, and comes into contact with the top of each sheet 207 in the direction of arrow A, to press the sheets 207. The rear ends of the sheets 207 in the conveyance direction are aligned by the pressing from the tip tapping member 204 and the reference fences 211.

The external ejection rollers 205 are rollers that constitute an ejection device that ejects a sheet bundle that is stacked on the staple tray 203 and has been subjected to a binding process performed by the side stapler 213 described later, to the outside.

The sheet catch tray 206 is the tray on which the ejected sheet bundle is stacked.

The reference fences 211 align the rear ends of the sheets 207 stacked on the staple tray 203 (the rear ends in the conveyance direction toward the staple tray 203), and serves as a sheet alignment member, in particular, an end alignment member.

The rear end pressing members 212 press, in the thickness direction, the rear end portions of the sheets 207 stacked on the staple tray 203, and serves as a sheet alignment member, in particular, an end press.

The side stapler 213 strikes staples into the rear end portion of a bundle of sheets stacked on the staple tray 203, and thus serves as a binder to bind together the bundle of sheets. On the staple tray 203, the leading end and the rear end of the sheets in the conveyance direction are aligned by the reference fences 211, and the bundle is restrained by the tip tapping member 204 in the thickness direction thereof. The side stapler 213 holds, with the staples, the upper surface and the bottom surface of the sheet bundle thus aligned, thereby binding together the sheets.

Flow of Binding Process

The flow of a binding process to be performed in the post-processing apparatus 20 is now described in greater detail. A sheet 207 ejected from the printer 10 passes through the introduction passage 201, and is ejected onto the staple tray 203 by the internal ejection rollers 202. After that, the leading end of the sheet 207 is tapped by the tip tapping member 204, and the rear end of the sheet 207 comes into contact with the reference fences 211. As a result, the top end, and the rear end of the sheet 207 are aligned.

At the same time as this aligning operation, the rear end pressing members 212 also operate, and are aligned so as to restrict the thickness of the rear end of the sheet 207. As these operations are repeated, a sheet bundle stacked on the staple tray 203 is formed.

After the last sheet 207 to be stacked is ejected onto the staple tray 203, and is stacked at the uppermost position of the sheet bundle, staples are put into the sheet bundle by the side stapler 213, so that an end binding process is performed.

Thereafter, the sheet bundle subjected to the end binding process is moved toward the external ejection rollers 205, and is ejected onto the sheet catch tray 206 by the external ejection rollers 205.

Outline of Binding Device

Figure 3:
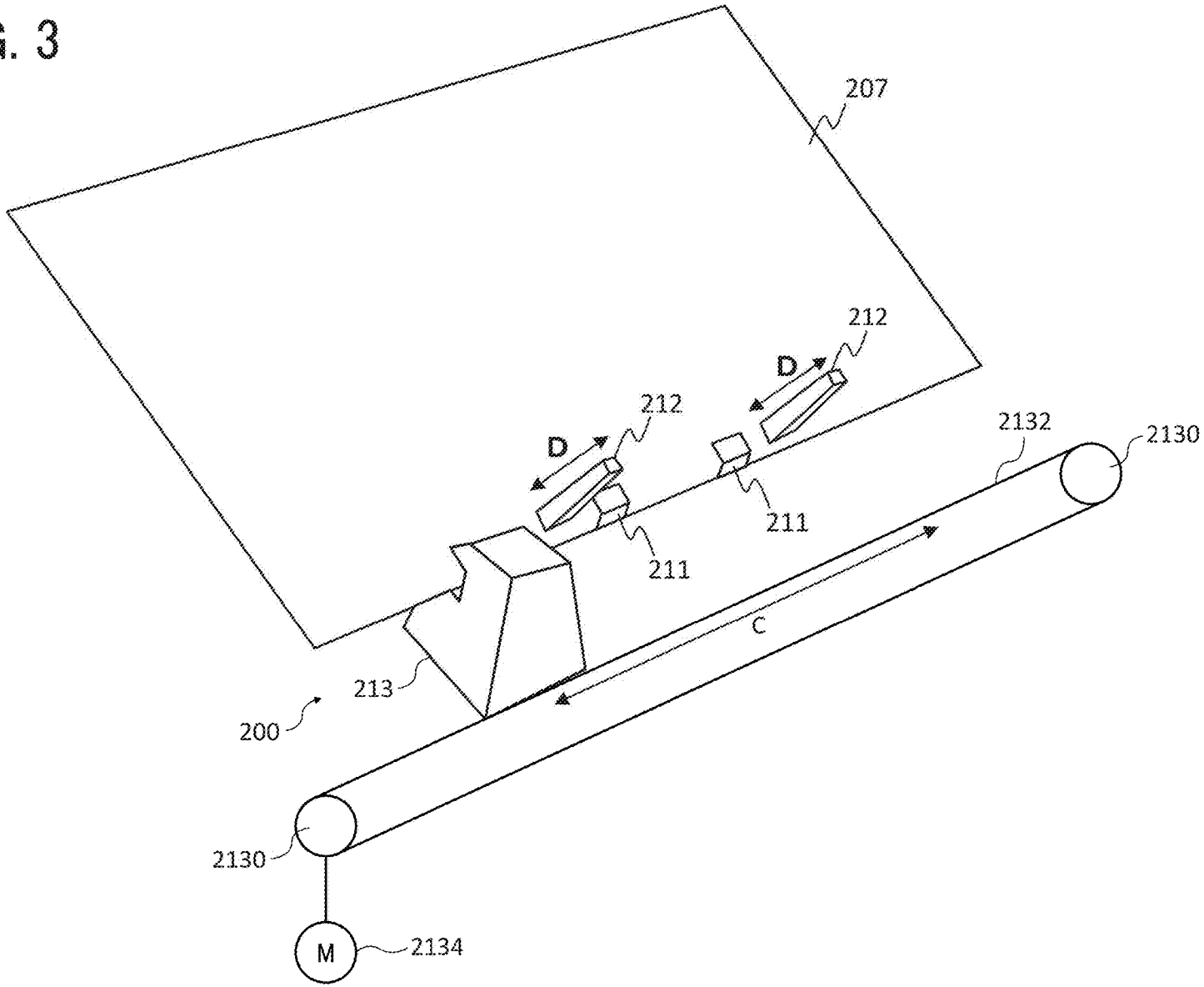
FIG. 3 is a perspective view illustrating an operational state of a binding device according to an embodiment of the present disclosure.

Next, a binding device according to an embodiment of the present disclosure is described. As illustrated in FIG. 3, the side binding device 200 according to the present embodiment includes the reference fences 211, the rear end pressing members 212, and the side stapler 213.

Next, operational states of the side binding device 200 and the problems during operation of the side stapler 213 are described with reference to FIGS. 3 through 8. As illustrated in FIG. 3, the side stapler 213 includes a stapler moving device, and is designed to move in the width direction of sheets 207 to perform a binding process at a plurality of positions.

The side stapler 213 is secured to a belt 2132 stretched around a pair of rollers 2130, and one of the rollers 2130 is coupled to a motor 2124 that can rotate forward and backward. The pair of rollers 2130, the belt 2132, and the motor 2134 constitute the stapler moving device (a binder moving device). As the motor 2124 rotates in the forward and reverse directions, the belt 2132 rotates in the forward and reverse directions via one of the rollers 2130, and the side stapler 213 is moved in the direction indicated by arrow C.

The side stapler 213 moves in the direction of arrow C illustrated in FIG. 3, and the moving range of the side stapler 213 covers the entire region of the side (end) of each sheet 207 to be bound (binding target side). The reference fences 211 and the rear end pressing members 212 are disposed in the middle of the entire region in the length direction.

When a sheet 207 is brought into contact with the reference fences 211, the rear end pressing members 212 move in the thickness direction of the sheet 207, to perform alignment. Therefore, the rear end pressing members 212 move in the direction of arrow D illustrated in FIG. 3.

Figure 4:
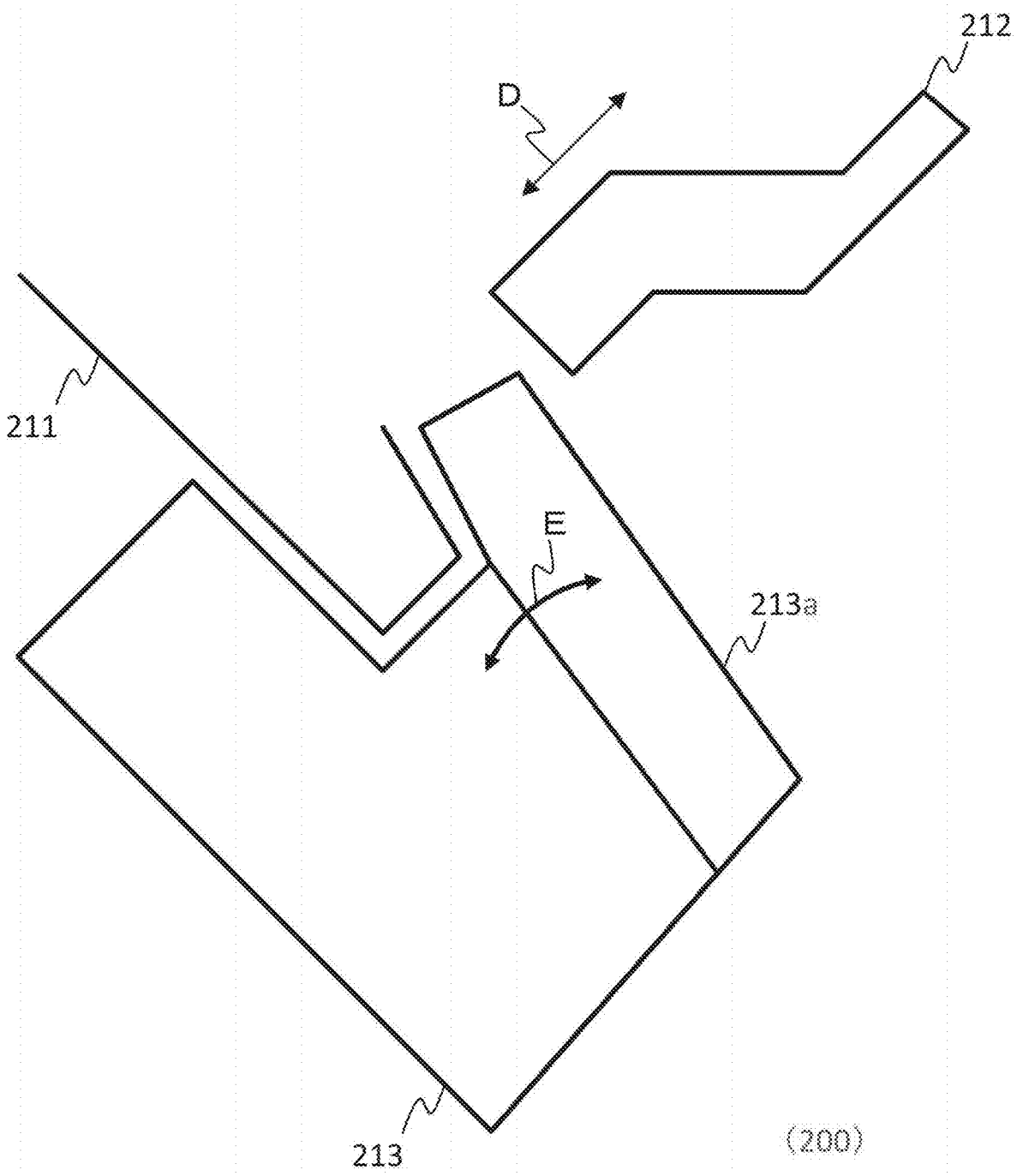
FIG. 4 is a front view illustrating an operational state of the binding device illustrated in FIG. 3.

FIG. 4 is an enlarged view of the side binding device 200 as viewed from the front, and illustrates the positional relationship among the binding operation direction of the side stapler 213, the operation direction of the rear end pressing members 212, and the reference fences 211. As illustrated in FIG. 4, the side stapler 213 includes a movable portion 213*a*. As the movable portion 213*a* rotates in the direction of arrow E, an end of a sheet 207 is gripped from above and below. Then, the side stapler 213 strikes a staple. Further, as illustrated in FIG. 4, the rear end pressing members 212 are movable in the direction of arrow D, and the reference fences 211 align the thickness direction of sheets 207 whose rear ends have been aligned in the direction of conveyance of the sheets 207 by the reference fences 211. Thus, the thickness direction of the sheets 207 becomes stable in a binding process and the like to be performed by the side stapler 213.

Figure 5A:
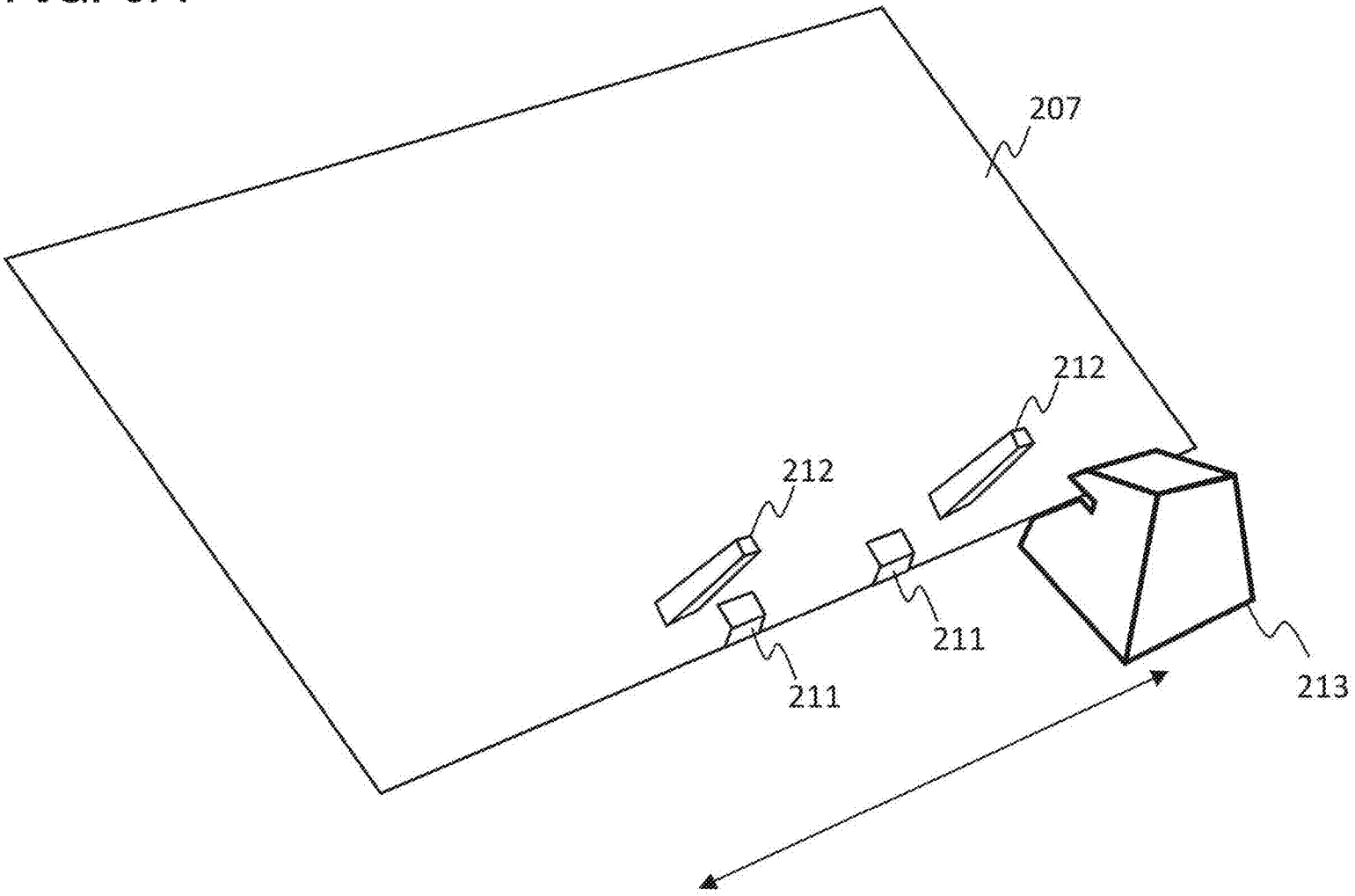
FIGS. 5A and 5B are perspective views of an example of an interference that occurs in the binding device.
Figure 5B:
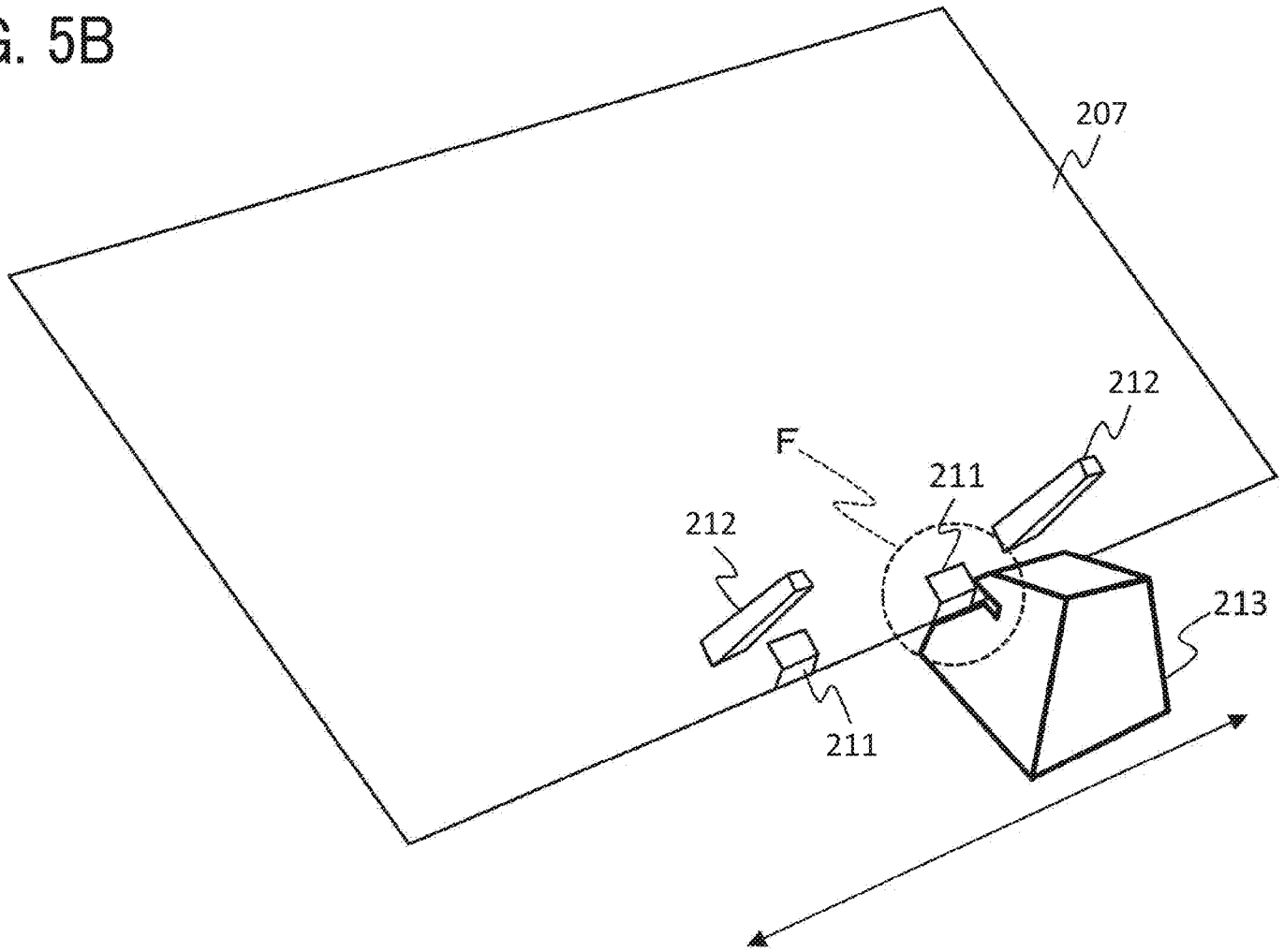

FIGS. 5A and 5B are perspective views for explaining a malfunction in a binding operation of the side stapler 213 and an operation of the movable portion 213*a*. As illustrated in FIG. 5A, after the movable portion 213*a* has rotated and binding has been performed at a given position, the movable portion 213*a* might not return to the original position. In this case, to perform binding at a plurality of positions, the side stapler 213 moves with the movable portion 213*a* closing the blank area for nipping the sheets 207. In this case, at the position indicated by a dotted circle F illustrated in FIG. 5B, the side stapler 213 interferes with the reference fence 211 in the movement path of the side stapler 213.

Figure 6:
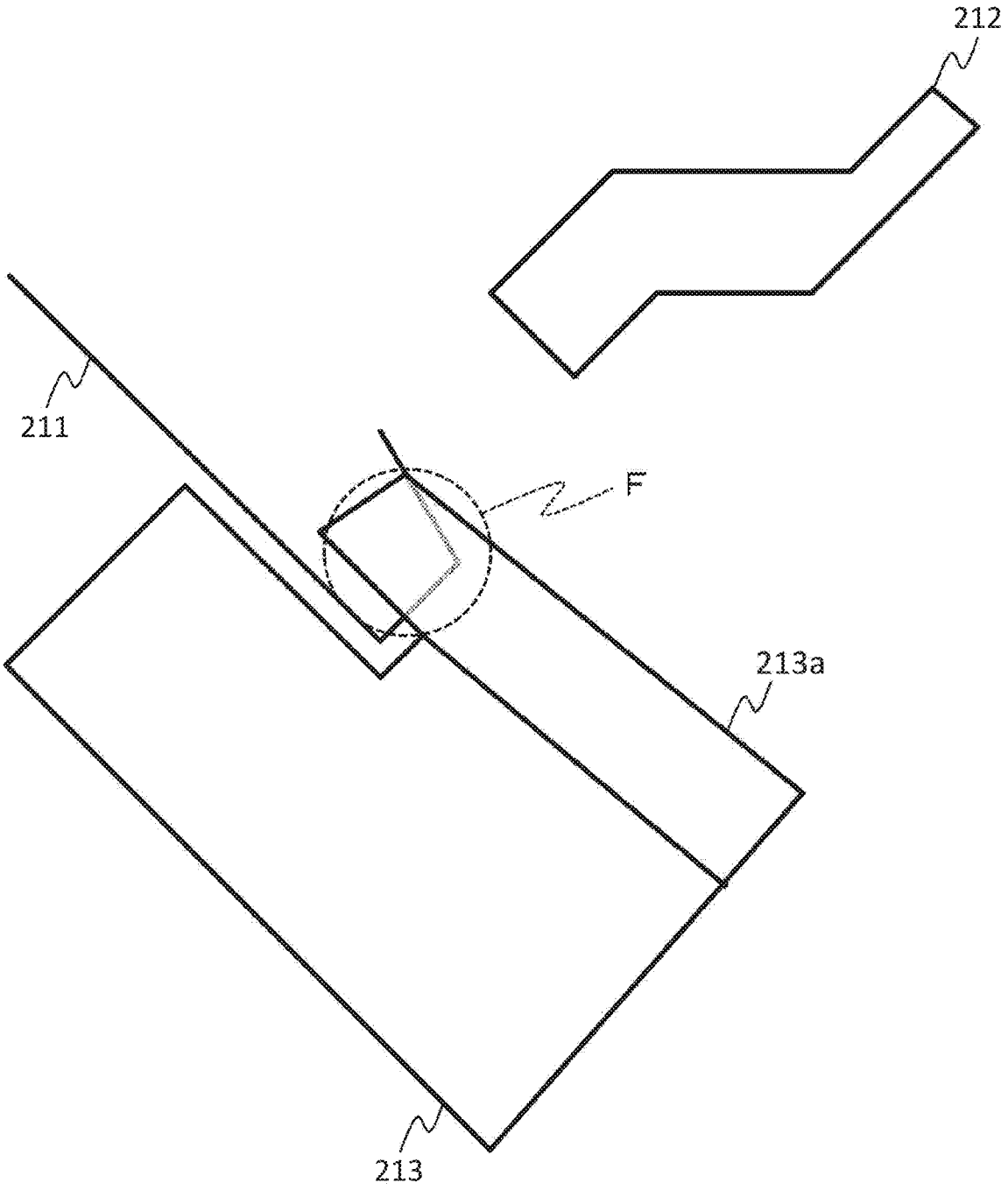
FIG. 6 is a front view of the example of the interference that occurs in the binding device.

FIG. 6 is an enlarged front view of FIG. 5B. As illustrated in FIG. 6, when the side stapler 213 collides with the reference fence 211, the side stapler 213 is prevented from moving. It is necessary to forcibly move the side stapler 213. For example, if a maintenance personnel forcibly moves the side stapler 213, there is a risk of damage to at least one of the reference fence 211 and the side stapler 213, which collide with each other.

Further, there may be a case where the rear end pressing members 212 do not return from the pressing position for some reason, and remains in the movement path of the side stapler 213. In such a case, the rear end pressing member 212 interferes with the portion indicated by a dotted circle G, as illustrated in perspective views in FIGS. 7A and 7B.

Figure 7A:
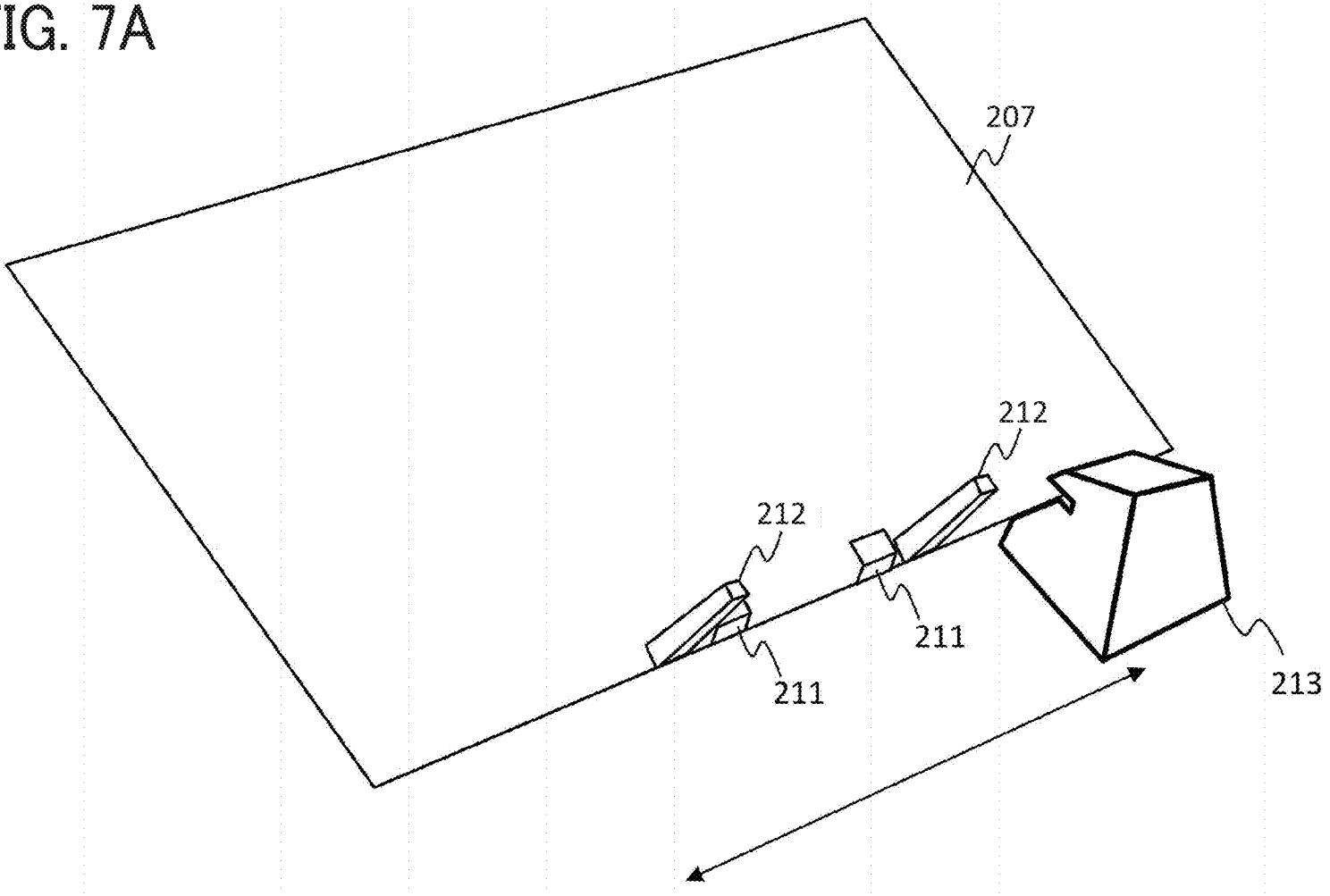
FIGS. 7A and 7B are perspective views of another example of the interference that occurs in the binding device.
Figure 7B:
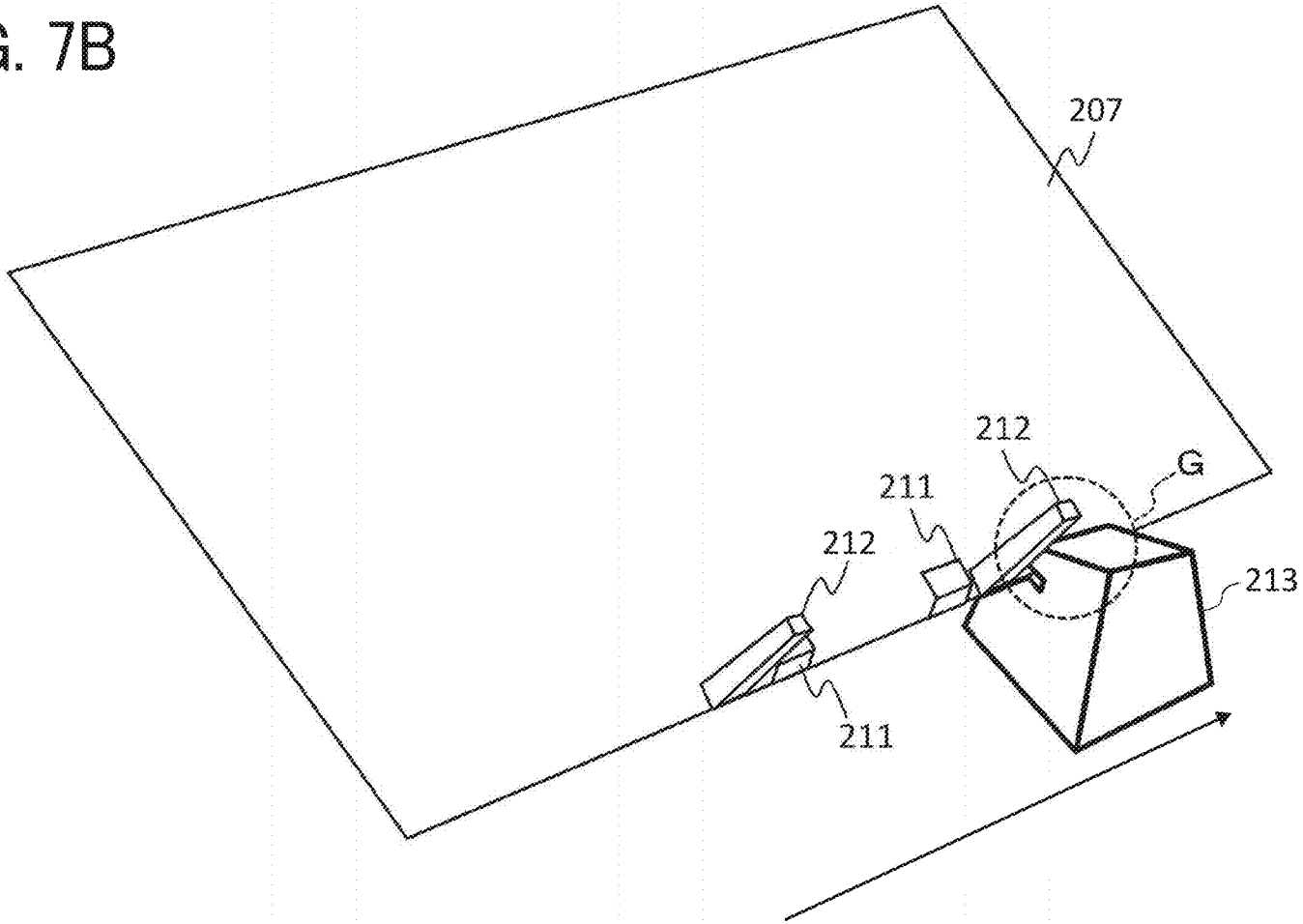
Figure 8:
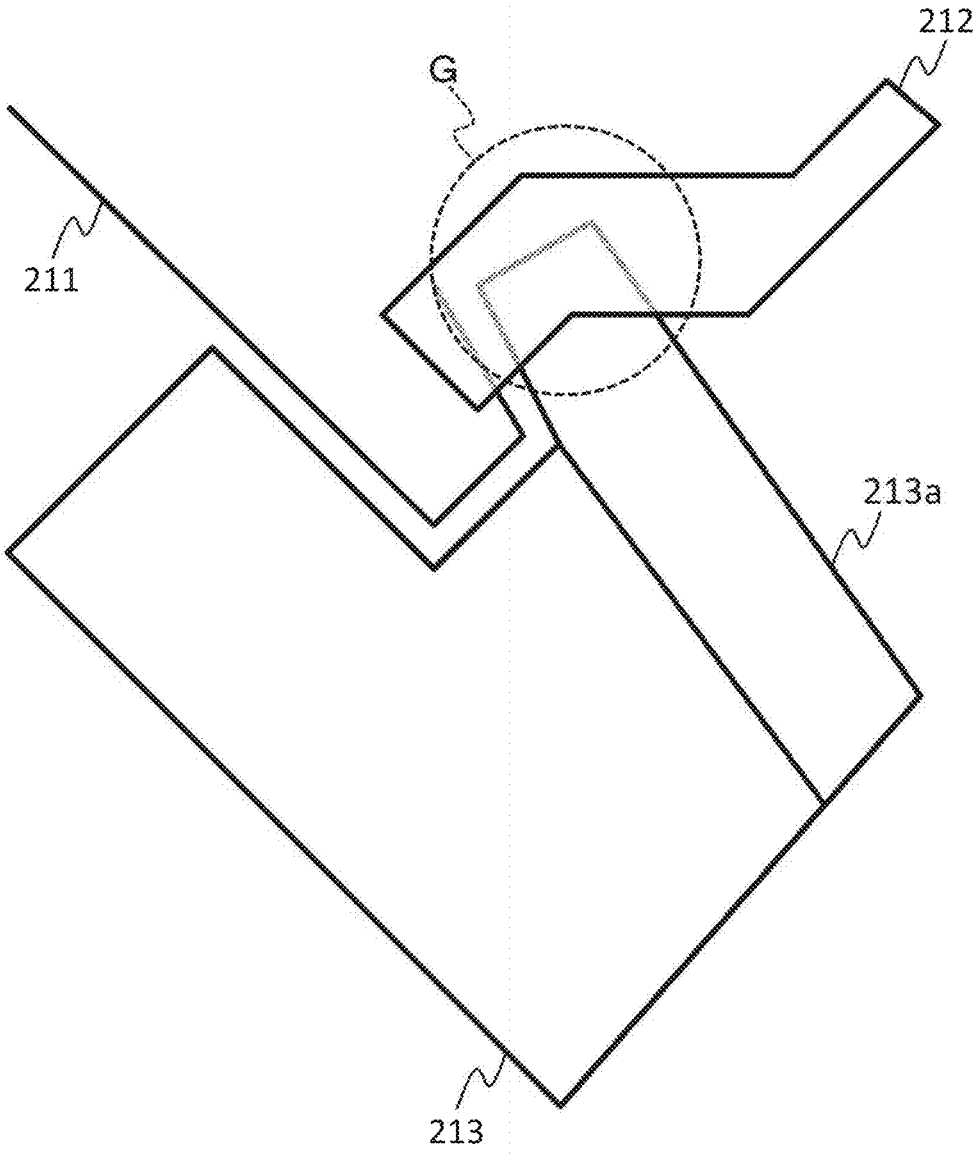
FIG. 8 is a front view of the interference state illustrated in FIGS. 7A and 7B.

FIG. 8 is an enlarged front view of FIG. 7B. As illustrated in FIG. 8, when the side stapler 213 interferes with a rear end pressing member 212, the side stapler 213 is prevented from moving. To solve this problem, it is necessary to forcibly move the side stapler 213. For example, in a case where a maintenance personnel forcibly moves the rear end pressing member 212, there is a possibility that at least one of the rear end pressing member 212 and the side stapler 213 is damaged.

Structure of Retreat Mechanism

The side binding device 200 includes a retreat mechanism that retreats the reference fences 211 and the rear end pressing members 212 when the reference fences 211 and the rear end pressing members 212 that may exist in the movement path of the side stapler 213 interfere with the side stapler 213 as described above. In the description below, the retreat mechanism will be described. The retreat mechanism corresponds to a retreat device of the present disclosure.

Configuration of First Retreat Structure

Figure 9:
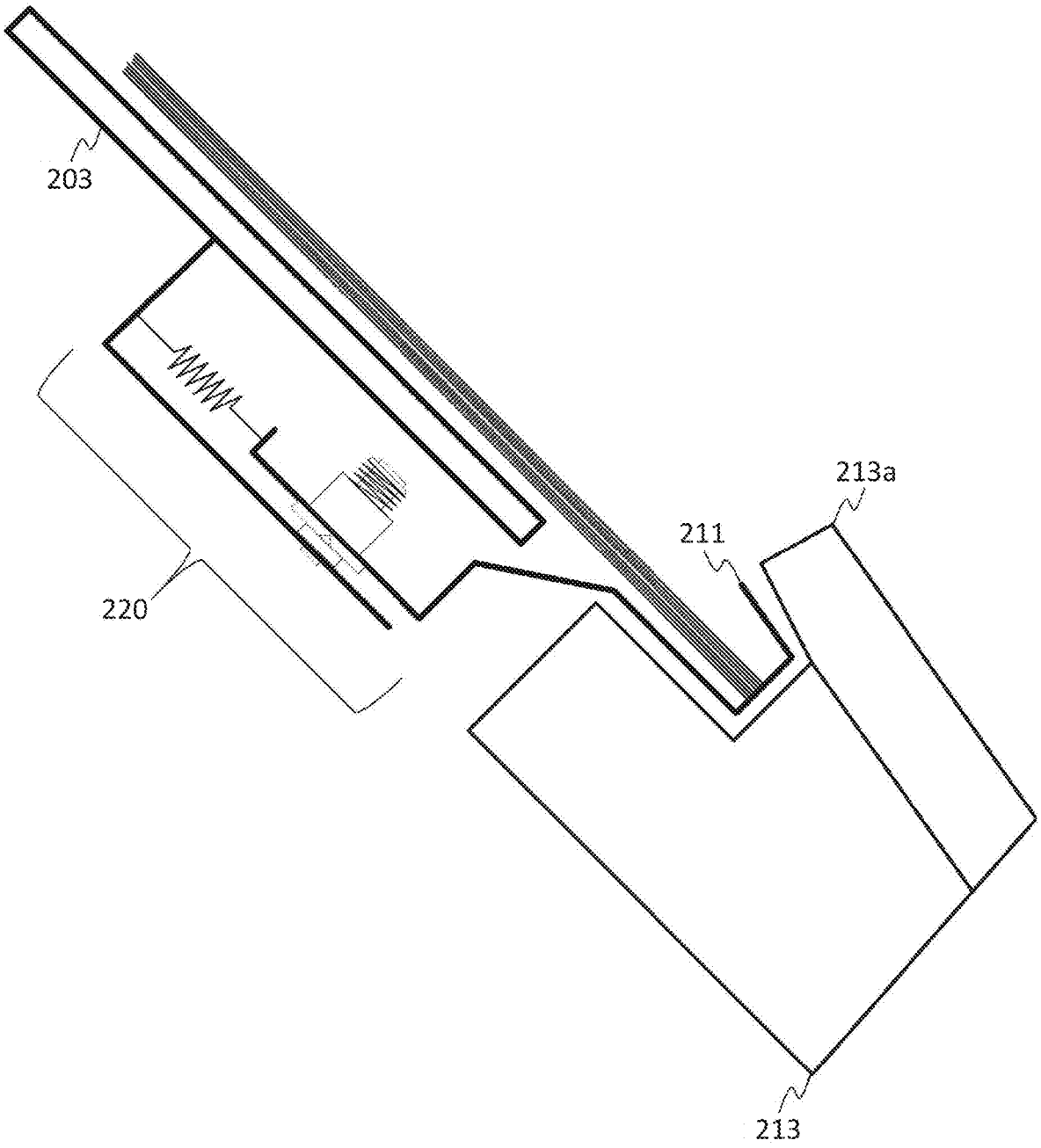
FIG. 9 is a front view of an example of an interference avoidance mechanism in the binding device.

FIG. 9 illustrates an example of a first retreat structure 220 included in the retreat mechanism. The first retreat structure 220 retreats the reference fences 211. As illustrated in FIG. 9, the first retreat structure 220 also serves as a holding structure that holds the reference fence 211 at a predetermined position. The first retreat structure 220 is secured to the back surface (on the opposite side from the surface on which the sheets 207 are stacked) of the staple tray 203.

Figure 10A:
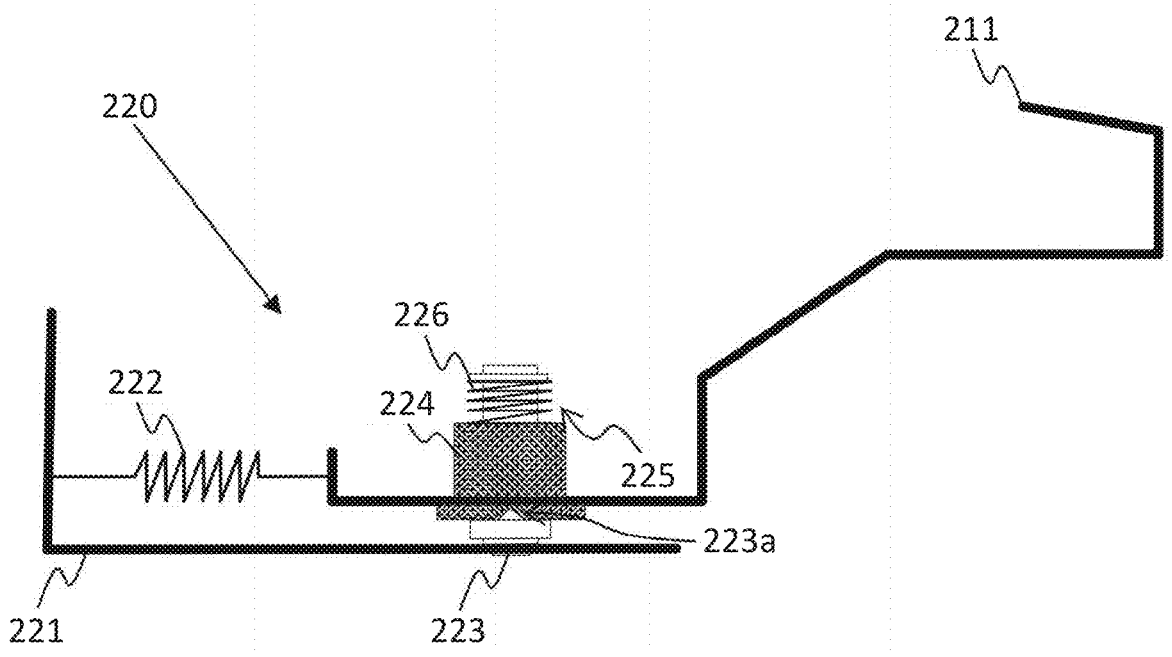
FIGS. 10A through 10C are front views illustrating in detail of the interference avoidance mechanism illustrated in FIG. 9.
Figure 10B:
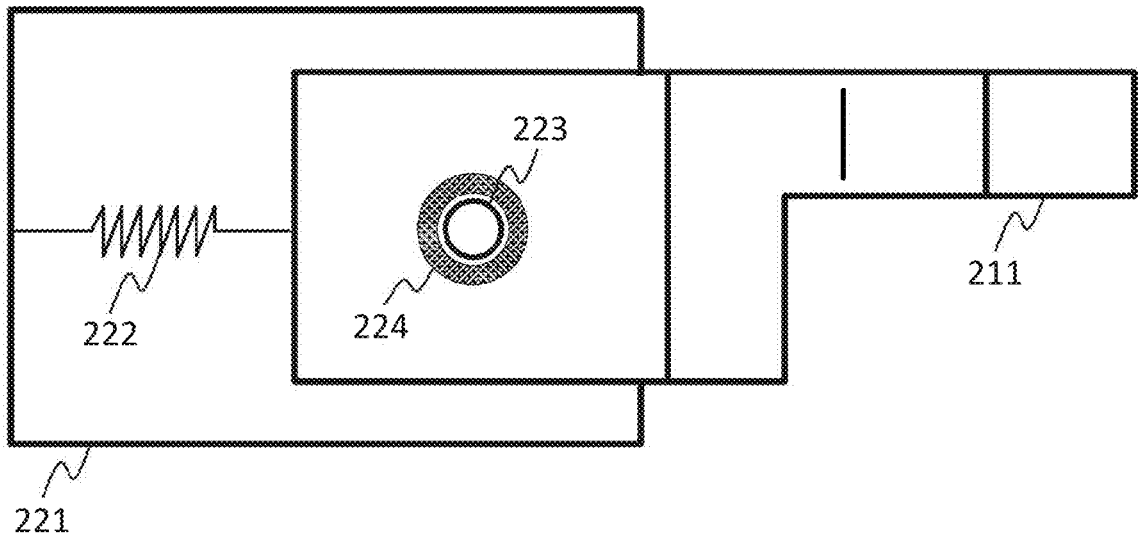
Figure 10C:
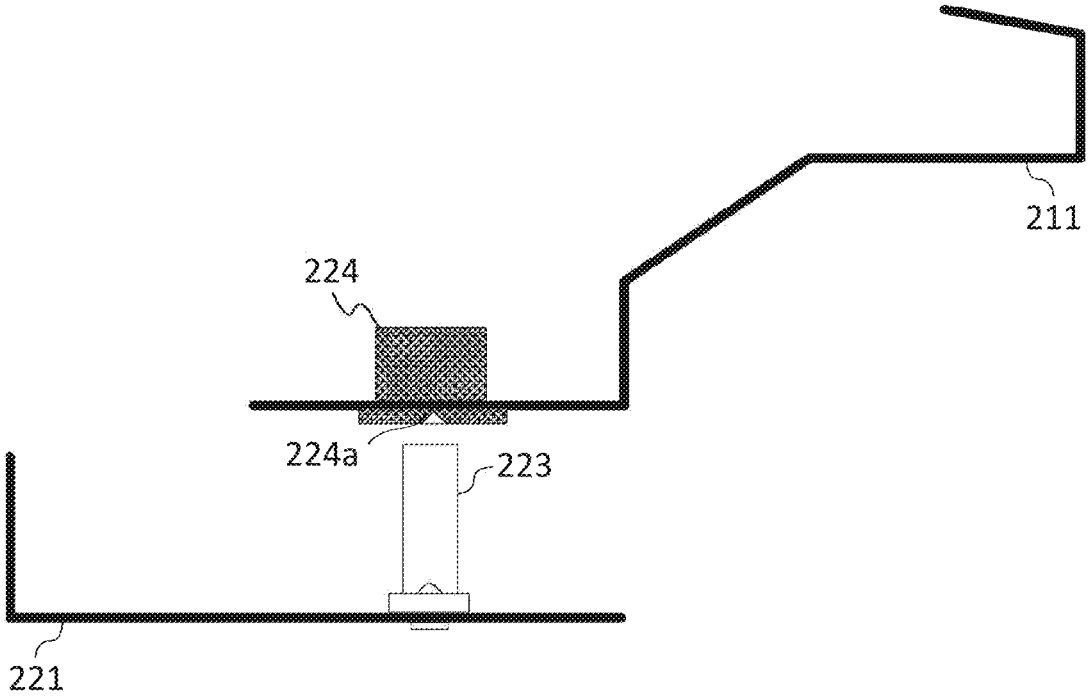

FIGS. 10A through 10C illustrate in detail the first retreat structure 220. FIG. 10A is a front view of the first retreat structure 220. FIG. 10B is a plan view of the first retreat structure 220. FIG. 10C is an exploded view of the first retreat structure 220. The first retreat structure 220 includes a first base 221, a first tension spring 222, a first stud 223, a bearing 224, a first compression spring 225, and a first thrust retaining ring 226.

The first base 221 is a component for securing the first retreat structure 220, which includes the reference fence 211, to the back surface of the staple tray 203.

The first tension spring 222 is an elastic member that pushes the end of the reference fence 211 toward the first base 221. When the reference fence 211 rotates about the first stud 223, the first tension spring 222 applies a restoring force to the reference fence 211 so that the reference fence 211 returns to the original position before the rotation.

The first stud 223 is the rotary shaft of the reference fence 211, is secured to the first base 221, and has a first protruding portion 223*a* to be engaged with a V-shaped groove 224*a* of the bearing 224. The first stud 223 serves as a rotation mechanism.

The bearing 224 is pushed (press-fit) into the reference fence 211, and has the V-shaped groove 224*a* with which the first protruding portion 223*a* is engaged.

The first compression spring 225 pushes the reference fence 211 toward the first base 221. The first compression spring 225 is disposed between the first thrust retaining ring 226 and the top surface of the bearing 224. When the first protruding portion 223*a* is disengaged from the V-shaped groove 224*a* due to rotation of the reference fence 211 about the first stud 223, the first compression spring 225 applies a restoring force acting in the axial direction to the reference fence 211.

The first thrust retaining ring 226 restricts the first compression spring 225 in the thrust direction so as to push the first compression spring 225.

As described above, in the first retreat structure 220, the bearing 224 is pushed (press-fit) into the reference fence 211, the first stud 223 is swaged to the first base 221, and the first stud 223 is inserted into the beating 224. The first stud 223 has the first protruding portion 223*a*, and the bearing 224 has the V-shaped groove 224*a*. As the first protruding portion 223*a* is engaged with the V-shaped groove 224*a*, the position of the reference fence 211 is secured.

Further, the first compression spring 225 pushes the engaging portion between the first protruding portion 223*a* and the V-shaped groove 224*a* to such an extent that the engagement is not canceled even when a weak force is applied in the direction in which the reference fence 211 is rotated.

When the rotational force of the reference fence 211 that has rotated becomes weaker, and the reference fence 211 is returned to the original position by the pushing force of the first tension spring 222, the engagement between the first protruding portion 223*a* and the V-shaped groove 224*a* stops the reference fence 211. In other words, the engagement structure between the first protruding portion 223*a* and the V-shaped groove 224*a* functions as a stopper as well as a restoration mechanism to return the reference fence 211 to the original position.

Operation of First Retreat Structure

Figure 11:
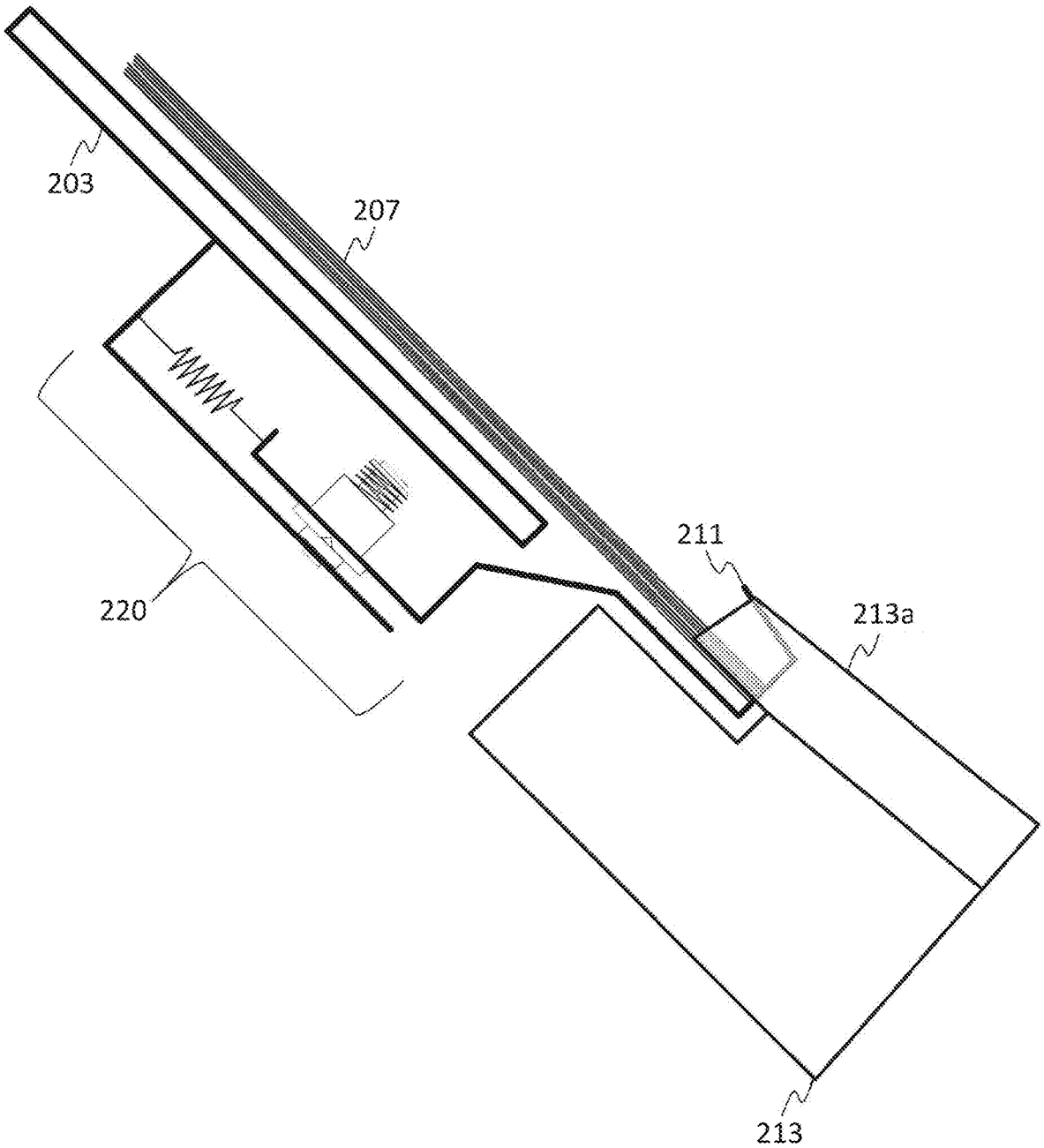
FIG. 11 is a front view of an example of interference that occurs in the binding device including the interference avoidance mechanism illustrated in FIGS. 10A to 10C.

Next, a retreating operation of the first retreat structure 220 is described with reference to FIGS. 11 through 17. FIG. 11 illustrates a state in which the reference fence 211 interferes with and the side stapler 213. A retreating operation of the reference fence 211 from this state is now described.

Figure 12:
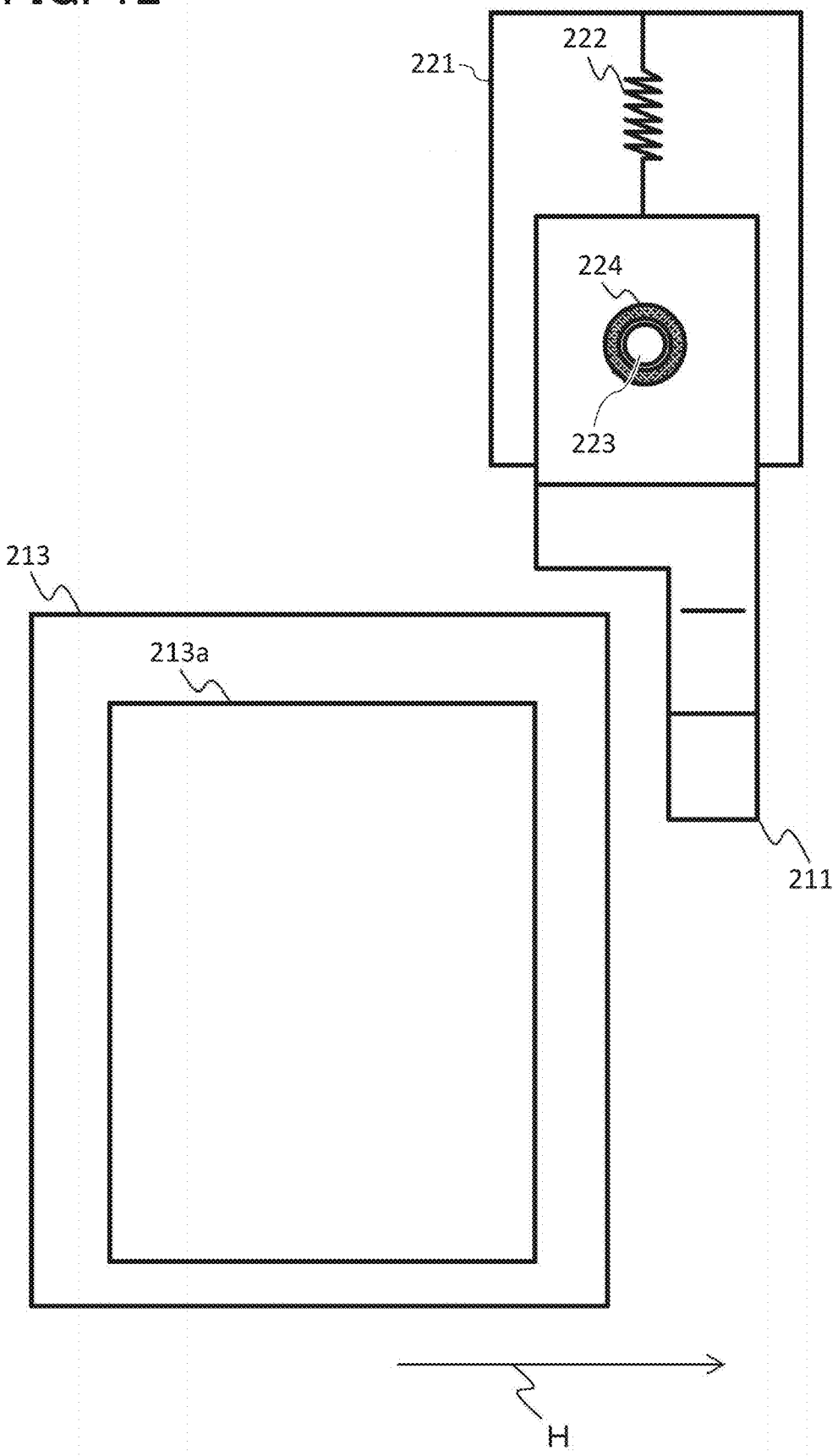
FIG. 12 is a side view illustrating an example of an interference avoidance operation in the interference avoidance mechanism.

FIG. 12 illustrates a state immediately before the side stapler 213 moves in the direction of arrow H and the movable portion 213*a* collides with the reference fence 211. In this case, after a binding process is completed, the movable portion 213*a* does not open as in a normal state, but stops in a closed state. When the side stapler 213 further moves in this state, the movable portion 213*a* contacts and interferes with the reference fence 211 at the position indicated by a dotted circle F illustrated in FIG. 13.

Figure 13:
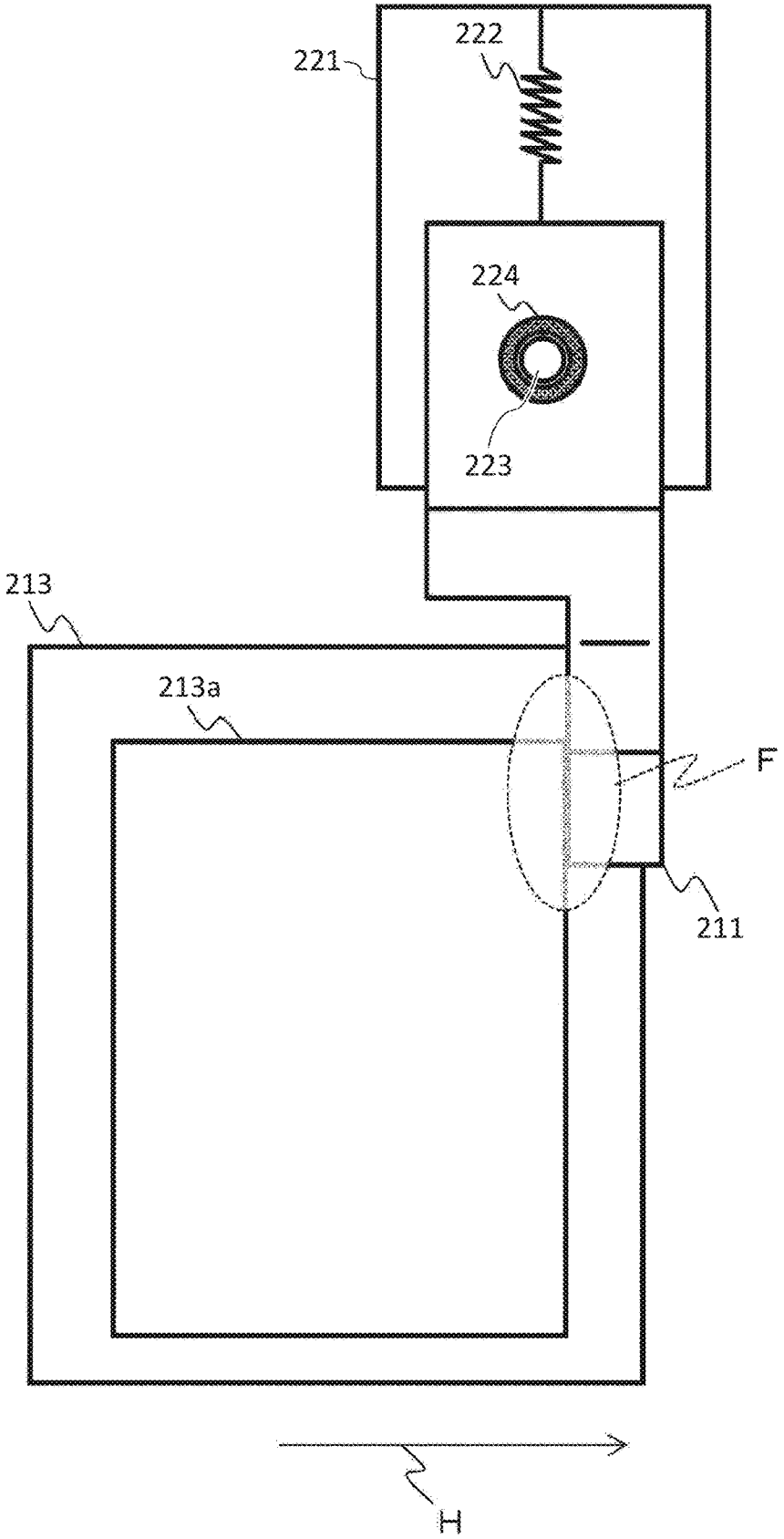
FIG. 13 is a side view illustrating another example of the interference avoidance operation in the interference avoidance mechanism.
Figure 14:
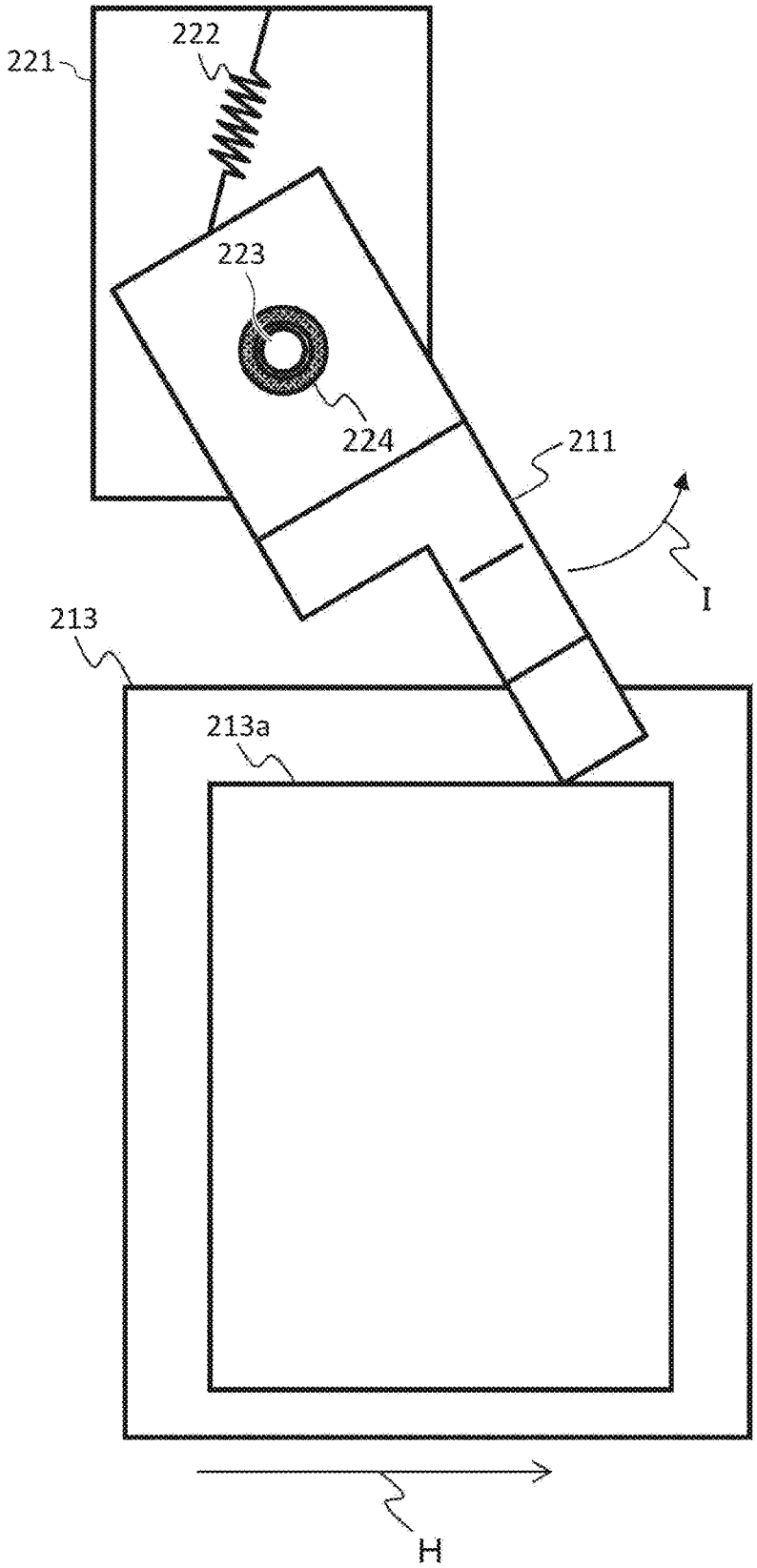
FIG. 14 is a side view illustrating another example of the interference avoidance operation in the interference avoidance mechanism.

In a case where the side stapler 213 is further moved in the direction of arrow H in the state illustrated in FIG. 13, the reference fence 211 rotates in the direction of an arc I as illustrated in FIG. 14. This is because, as a pressing force from the moving direction of the side stapler 213 is applied to the reference fence 211, the bearing 224 rotates with respect to the first stud 223, and the first protruding portion 223*a* is disengaged from the V-shaped groove 224*a* of the bearing 224. That is, when the rotational force of the reference fence 211 exceeds the engagement force between the first protruding portion 223*a* and the V-shaped groove 224*a* of the bearing 224 (the pushing force of the first compression spring 225), the reference fence 211 rotates as in the example illustrated in FIG. 14.

Figure 15:
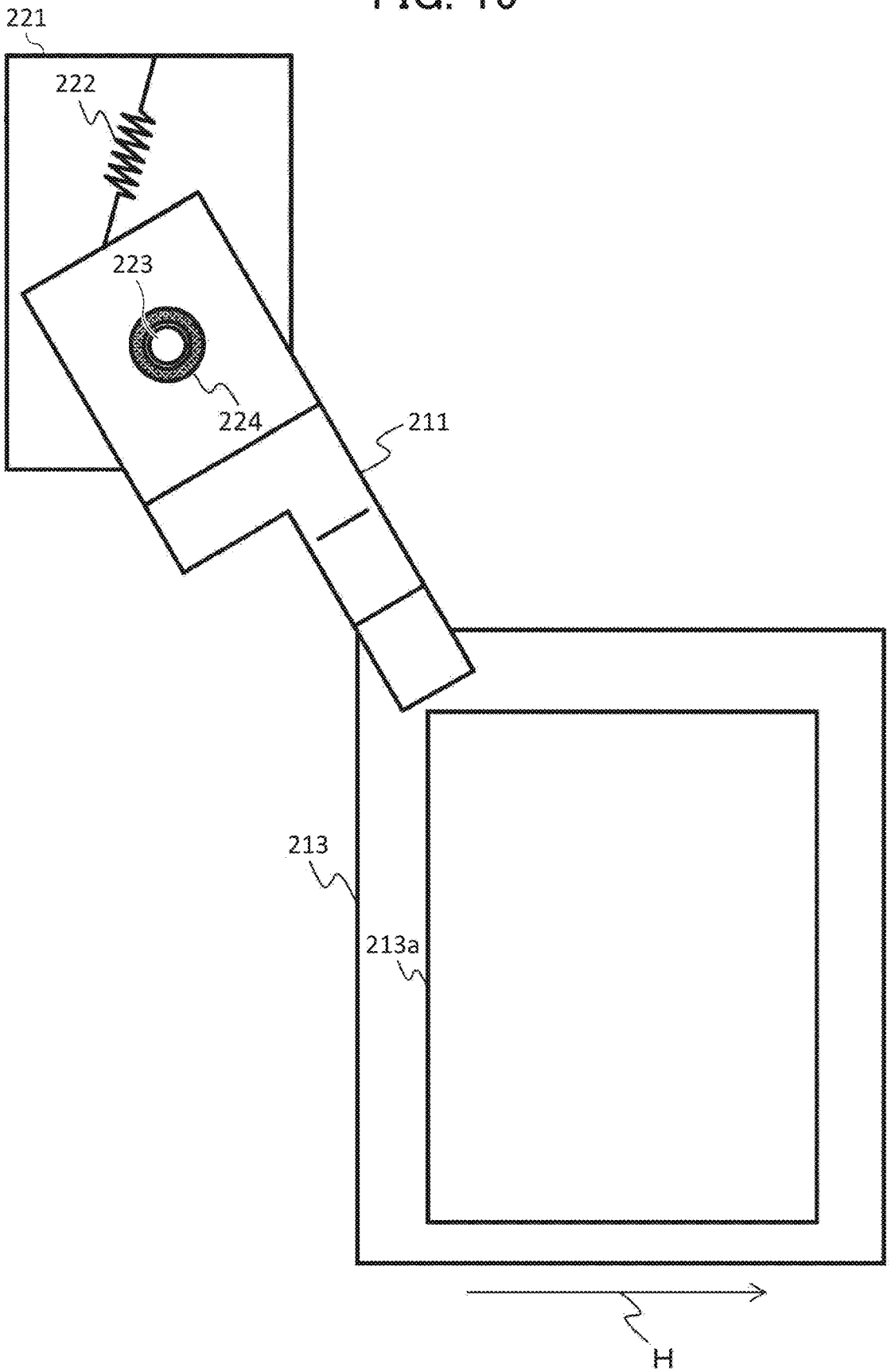
FIG. 15 is a side view illustrating another example of an interference avoidance operation in the interference avoidance mechanism.
Figure 16:
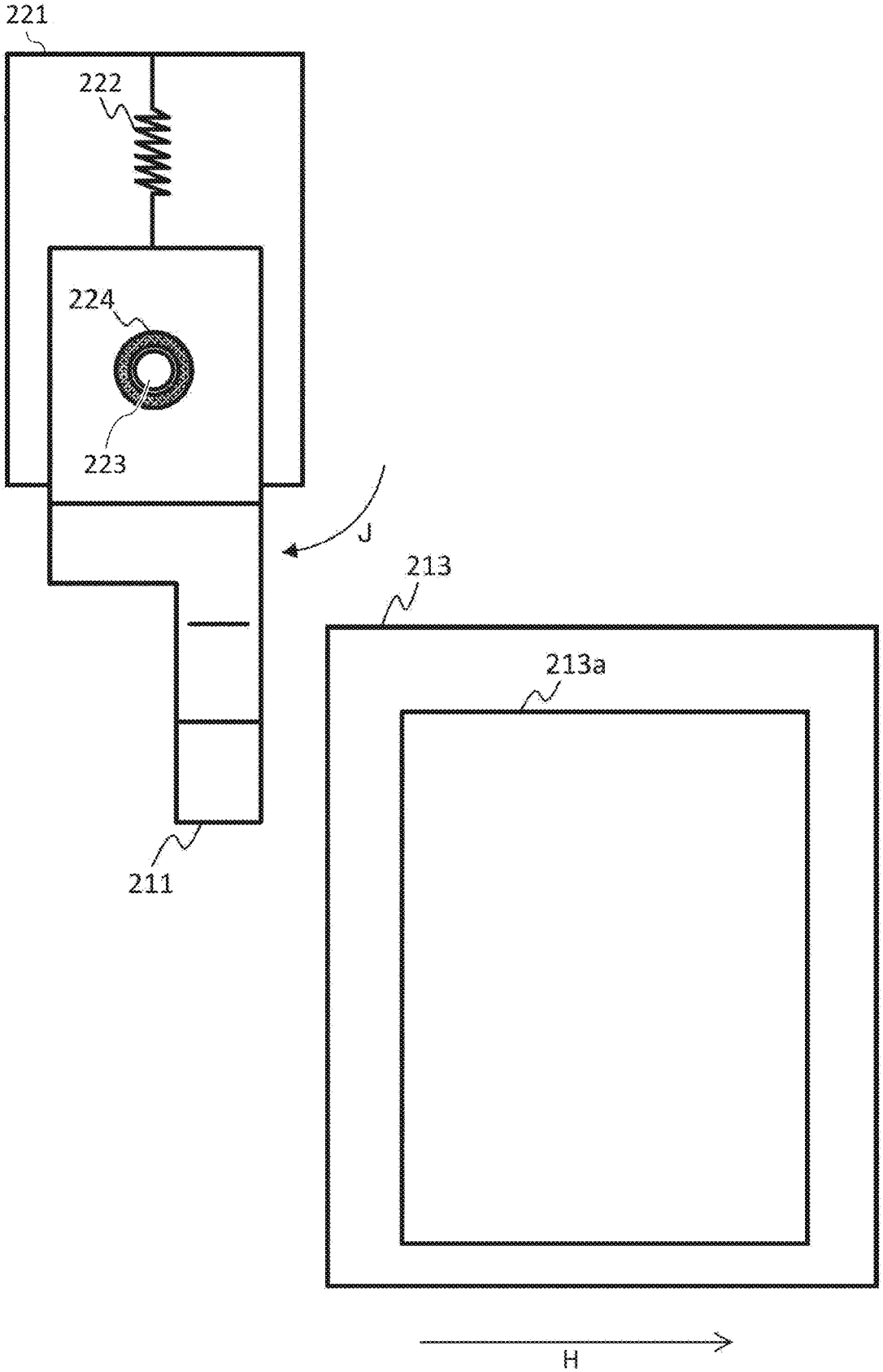
FIG. 16 is a side view illustrating another example of the interference avoidance operation in the interference avoidance mechanism.

When the side stapler 213 is further moved in the direction of arrow H, the reference fence 211 can be retreated from the range of movement of the movable portion 213*a*, to allow the side stapler 213 to move, as illustrated in FIG. 15. When the side stapler 213 is then moved further, the reference fence 211 becomes free of interference with the movable portion 213*a*. Thus, the reference fence 211 rotates in the direction of an arc J, being pushed by the first tension spring 222, as illustrated in FIG. 16. This rotation in the direction of the arc J is caused by the first tension spring 222. As a result, the reference fence 211 becomes ready to return to the original state before the reference fence 211 interferes with the movable portion 213*a*.

After that, when the reference fence 211 returns to a position near the original position at which the reference fence 211 does not interfere with the movable portion 213*a*, the first protruding portion 223*a* is engaged with the V-shaped groove 224*a* of the bearing 224 pushed by the first compression spring 225, and the rotation is stopped in the restored state. Thus, the reference fence 211 can automatically return to the original position.

Figure 17:
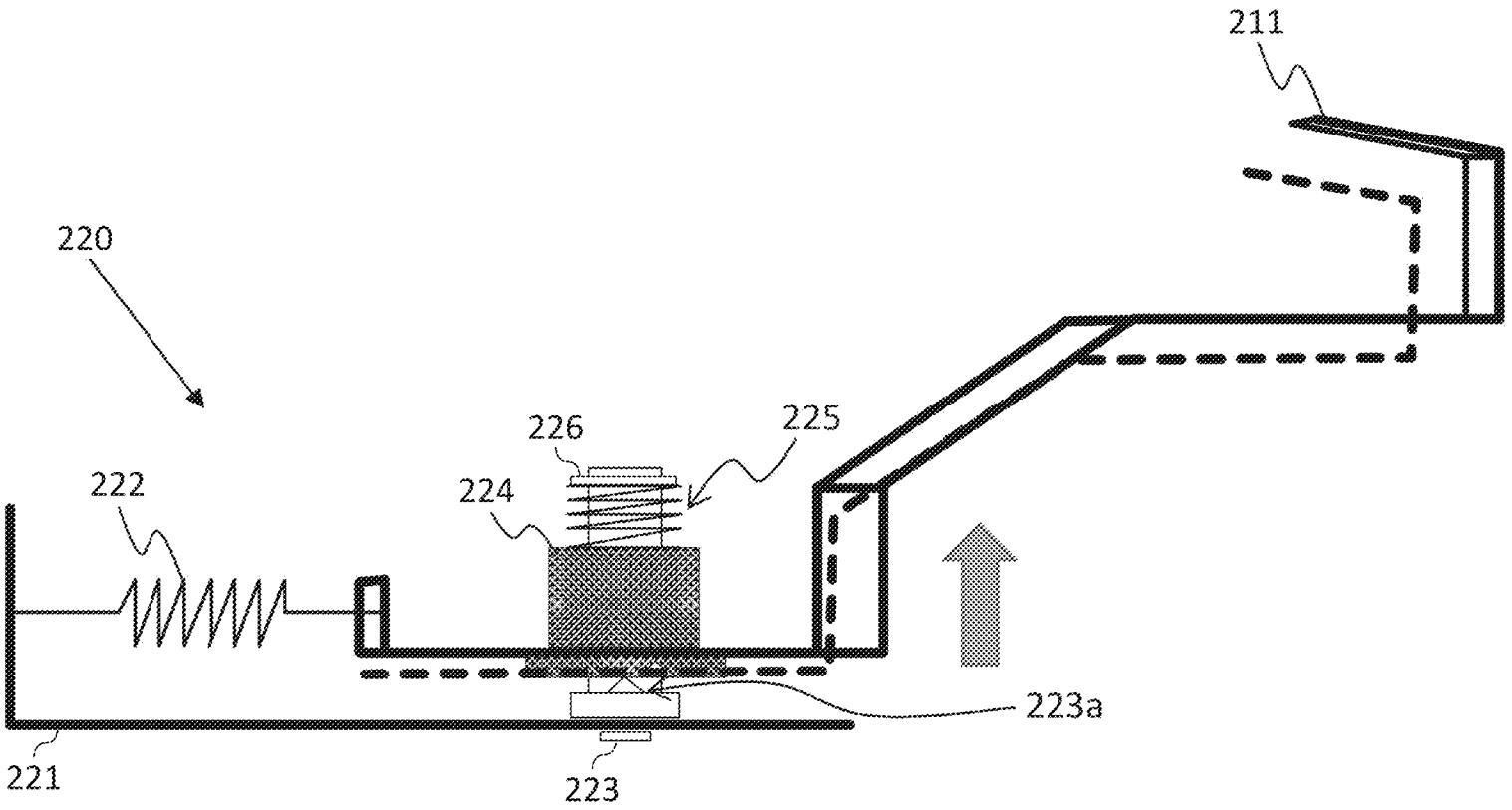
FIG. 17 is a front view illustrating the interference avoidance operation in the interference avoidance mechanism.

FIG. 17 is a front view illustrating a state in which the reference fence 211 has rotated, and the first protruding portion 223*a* is disengaged from the V-shaped groove 224*a*. As illustrated in FIG. 17, when the force caused by the rotation of the reference fence 211 and acting on the engagement portion between the first protruding portion 223*a* and the V-shaped groove 224*a* exceeds the pushing force of the first compression spring 225, the engagement is released, and the reference fence 211 moves away from the first base 221. As a result, the engagement is cancelled, and the reference fence 211 can rotate in accordance with the moving direction of the side stapler 213.

After that, when any force is no longer applied to the reference fence 211 (when the collision with the side stapler 213 is resolved), the restoring force of the first tension spring 222 acts as a force in the direction opposite from the direction of rotation of the reference fence 211. After that, an engagement portion is again formed, and thus, the reference fence 211 returns to the original position.

As described above, the side binding device 200 according to the present embodiment is capable of moving a reference fence 211 as an alignment device between an alignment position (operation position) and a retreat position to which the reference fence 211 is retreated from interference with the side stapler 213. As a result, when the side stapler 213 operates in a broken state, or is forcibly moved by a user or a maintenance personnel, the reference fence 211 can be easily retreated from interference with the side stapler 213. Further, after the reference fence 211 is retreated from the range of movement of the side stapler 213, the reference fence 211 can be automatically returned to the alignment position.

Configuration of Second Retreat Structure

Figure 18B:
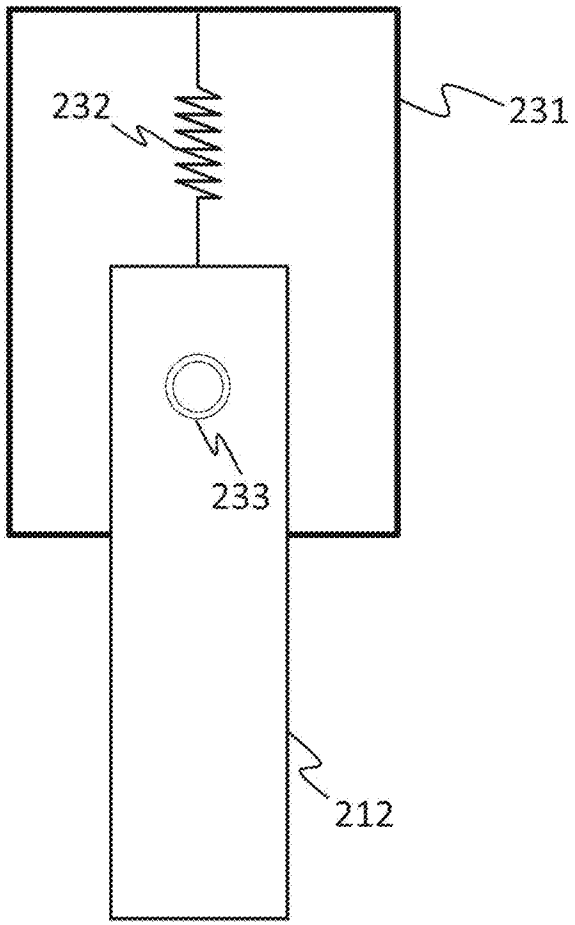
FIGS. 18A and 18B are front views of another interference avoidance mechanism in the binding device.
Figure 18A:
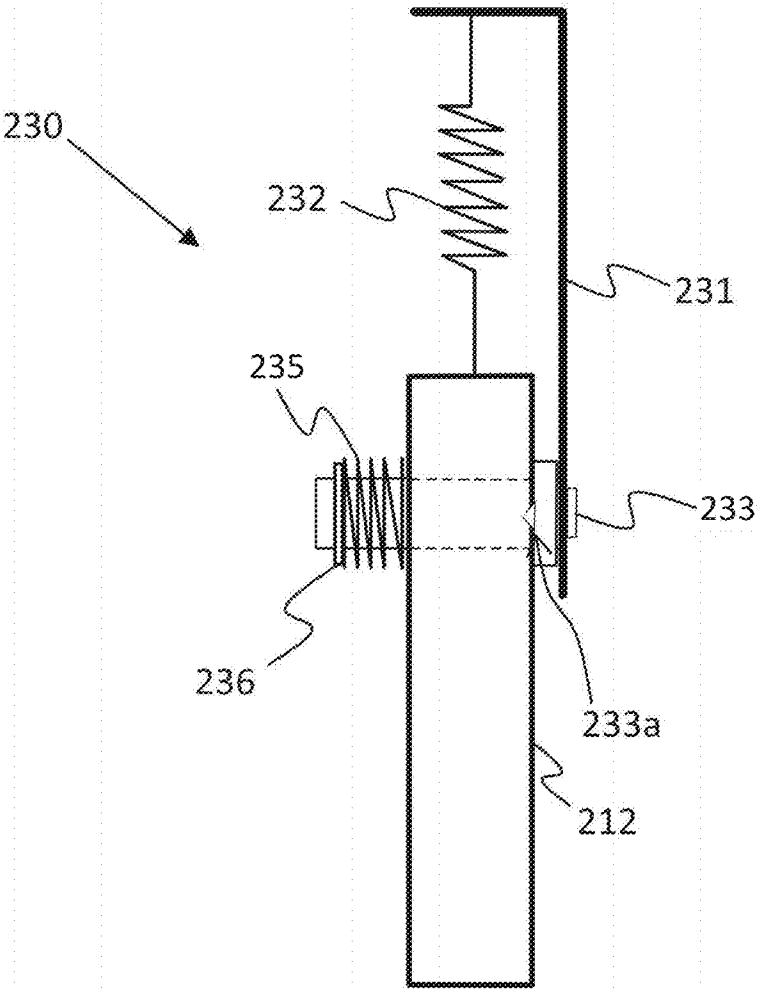

FIGS. 18A and 18B illustrate an example of a second retreat structure 230 included in the retreat mechanism. The second retreat structure 230 retreats the rear end pressing member 212. As illustrated in FIGS. 18A and 18B, the second retreat structure 230 also serves as a holding structure that holds the rear end pressing member 212 at a predetermined positron.

FIGS. 18A and 18B are diagrams illustrating a specific configuration of the second retreat structure 230. FIG. 18A is a front view of the second retreat structure 230. FIG. 18B is a plan view of the second retreat structure 230. The second retreat structure 230 includes a second base 231, a second tension spring 232, a second stud 233, a second compression spring 235, and a second thrust retaining ring 236.

The second base 231 is a component for securing the second retreat structure 230 including the rear end pressing member 212 to the side binding device 200.

The second tension spring 232 is an elastic member that pushes the end of the rear end pressing member 212 toward the second base 231. When the rear end pressing member 212 rotates about the second stud 233, the second tension spring 232 applies a restoring force to return the rear end pressing member 212 to the original position. The rear end pressing member 212 is made of a resin material. Therefore, there is no need to prepare a bearing for rotatably holding the second stud 233.

The second stud 233 is the rotary shaft of the rear end pressing member 212, is secured to the second base 231, and has a second protruding portion 233*a* to be engaged with a V-shaped groove 224*a* formed in the rear end pressing member 212. The second stud 233 serves as a rotation mechanism.

The second compression spring 235 is an elastic member that pushes the rear end pressing member 212 toward the second base 231. The second compression spring 235 is disposed between the second thrust retaining ring 236 and the top surface of the rear end pressing member 212. When the second protruding portion 233*a* is disengaged from the V-shaped groove 224*a* due to rotation of the rear end pressing member 212 about the second stud 233, the second compression spring 235 applies a restoring force acting in the axial direction to the rear end pressing member 212.

The second thrust retaining ring 236 restricts the thrust direction so as to push the second compression spring 235.

As described above, in the second retreat structure 230, the second stud 233 secured to the first base 221 is inserted into a hole formed in the rear end pressing member 212. The second stud 233 has the second protruding portion 233*a*, and the rear end pressing member 212 has the V-shaped groove 224*a*. As the second protruding portion 233*a* is engaged with the V-shaped groove 224*a*, the position of the rear end pressing member 212 is maintained.

Further, the second compression spring 235 pushes the engaging portion between the second protruding portion 233*a* and the V-shaped groove 224*a* to such an extent that the engagement portion is not cancelled even when a small amount of force is applied in the direction in which the rear end pressing member 212 is rotated.

When the rotational force of the rear end pressing member 212 that has rotated becomes weaker and the rear end pressing member 212 is returned to the original position by the pushing force of the second tension spring 232, the engagement structure between the second protruding portion 233*a* and the V-shaped groove 224*a* stops the movement of the second retreat structure 230. In other words, the engagement structure between the second protruding portion 233*a* and the V-shaped groove 224*a* is a stopper, and is a restoration mechanism that returns the rear end pressing member 212 to the original position.

Operation of Second Retreat Structure

Figure 19:
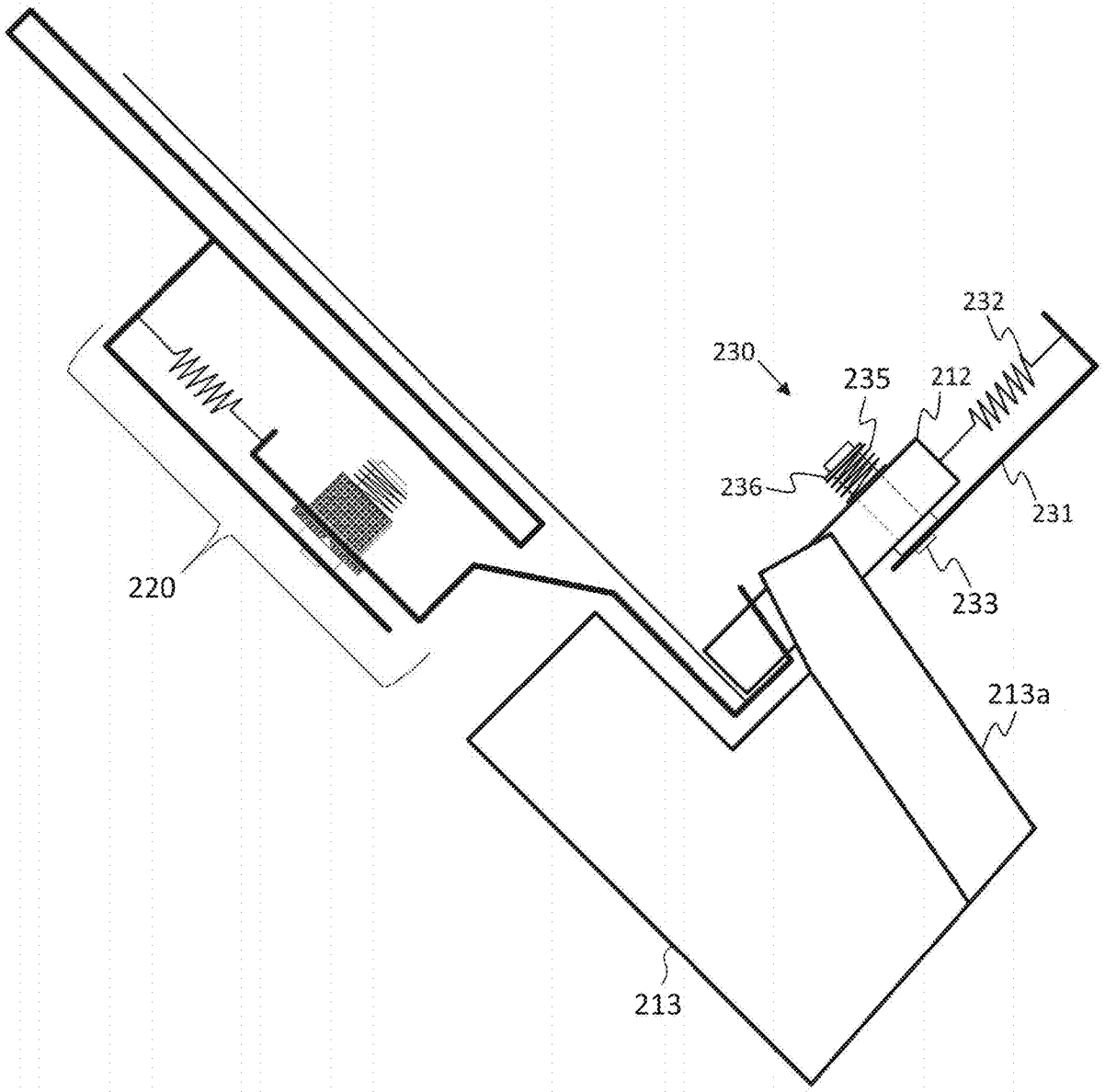
FIG. 19 is a front view of the interference avoidance mechanism illustrated in FIGS. 18A to 18C.

Next, a retreating operation at the second retreat structure 230 is described with reference to FIGS. 19 through 25. FIG. 19 illustrates a state in which the rear end pressing member 212 interferes with the side stapler 213. A retreating operation of the rear end pressing member 212 from this state is now described.

Figure 20:
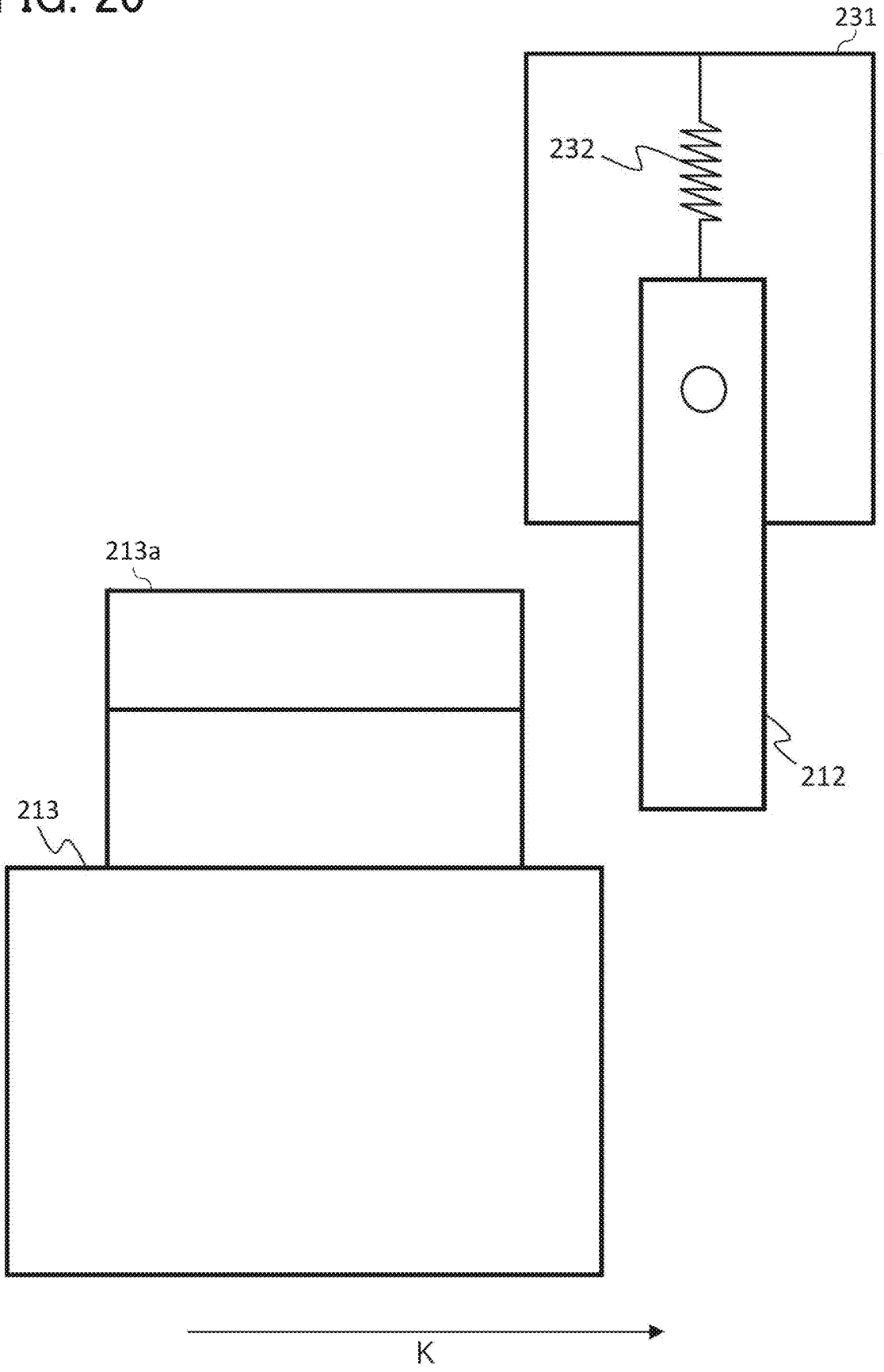
FIG. 20 is a side view illustrating an example of an interference avoidance operation in the interference avoidance mechanism.

FIG. 20 illustrates a state immediately before the side stapler 213 moves in the direction of arrow K and the movable portion 213*a* collides with the rear end pressing member 212. When the side stapler 213 further moves in this state, the movable portion 213*a* contacts and interferes with the rear end pressing member 212 at the position indicated by a dotted circle G as illustrated in FIG. 21.

Figure 21:
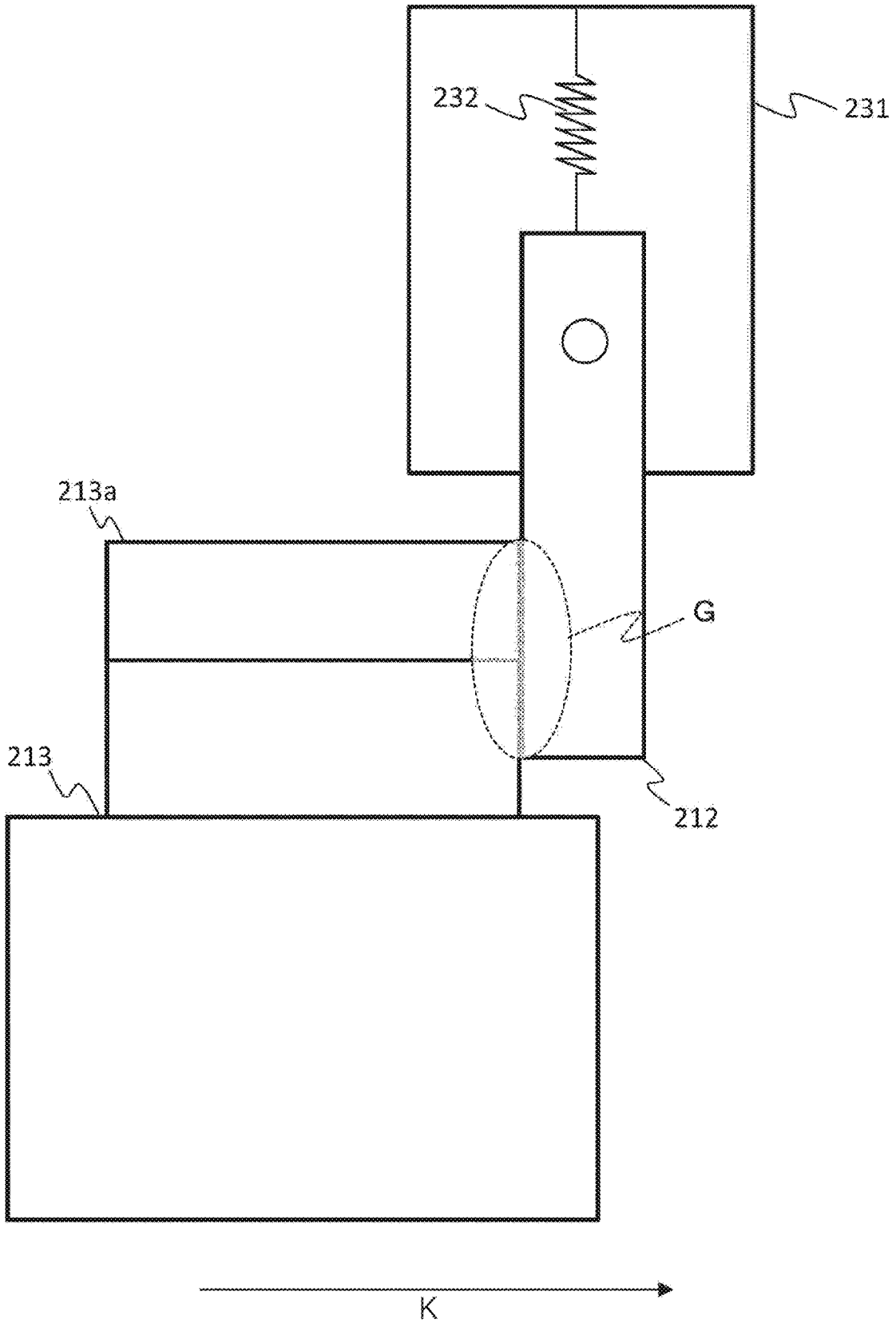
FIG. 21 is a side view illustrating another example of the interference avoidance operation in the interference avoidance mechanism.
Figure 22:
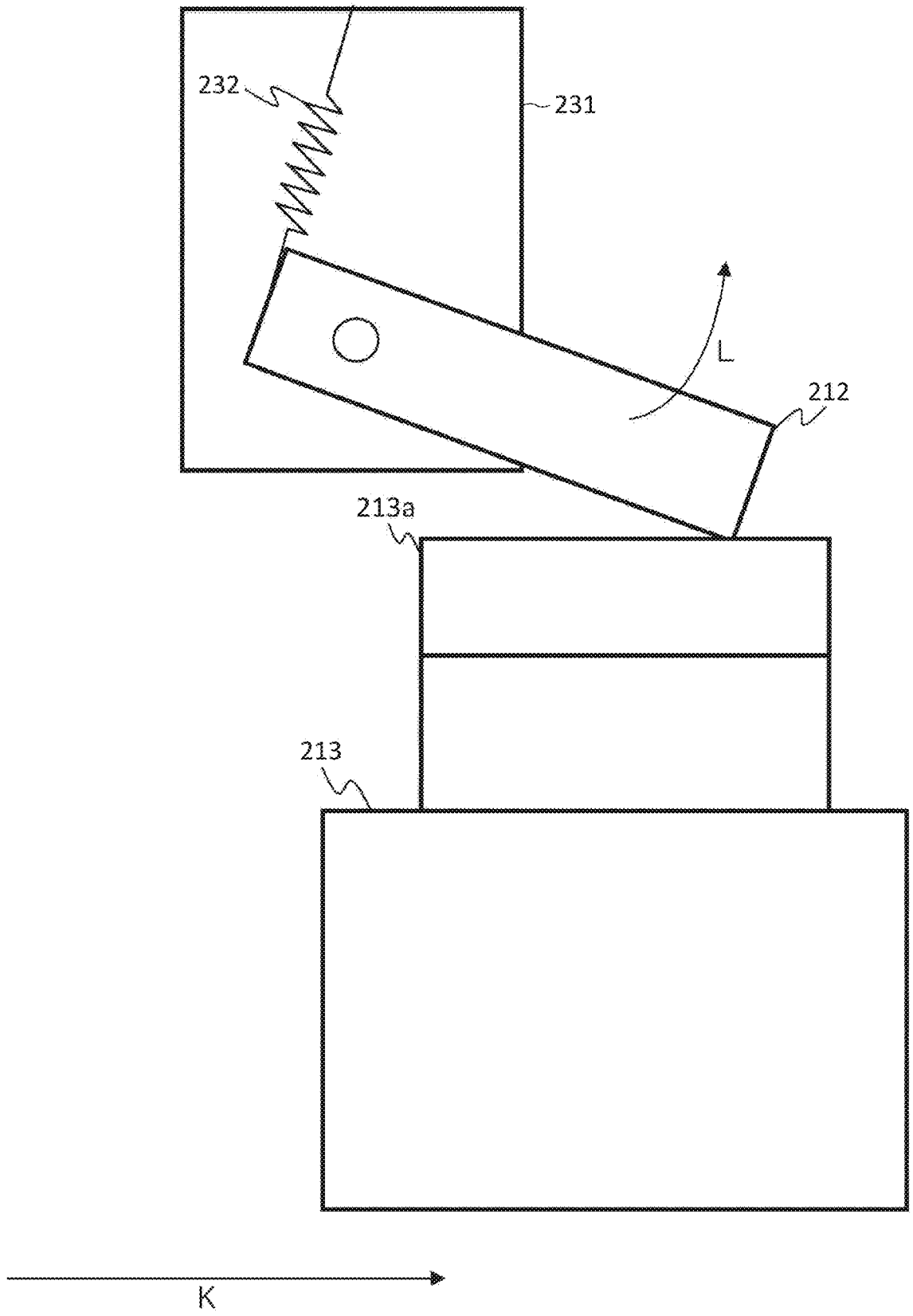
FIG. 22 is a side view illustrating another example of the interference avoidance operation in the interference avoidance mechanism.

In a case where the side stapler 213 is further moved in the direction of arrow K in the state illustrated in FIG. 21, the rear end pressing member 212 rotates in the direction of an arc L as illustrated in FIG. 22. This is because, as a pressing force from the moving direction of the side stapler 213 is applied to the rear end pressing member 212, the rear end pressing member 212 rotates with respect to the second stud 233, and the second protruding portion 233*a* is disengaged from the V-shaped groove 224*a*. That is, when the rotational force of the rear end pressing member 212 exceeds the engagement force between the second protruding portion 233*a* and the V-shaped groove 224*a* of the rear end pressing member 212 (the pushing force of the second compression spring 235), the rear end pressing member 212 rotates as in the example illustrated in FIG. 23.

Figure 23:
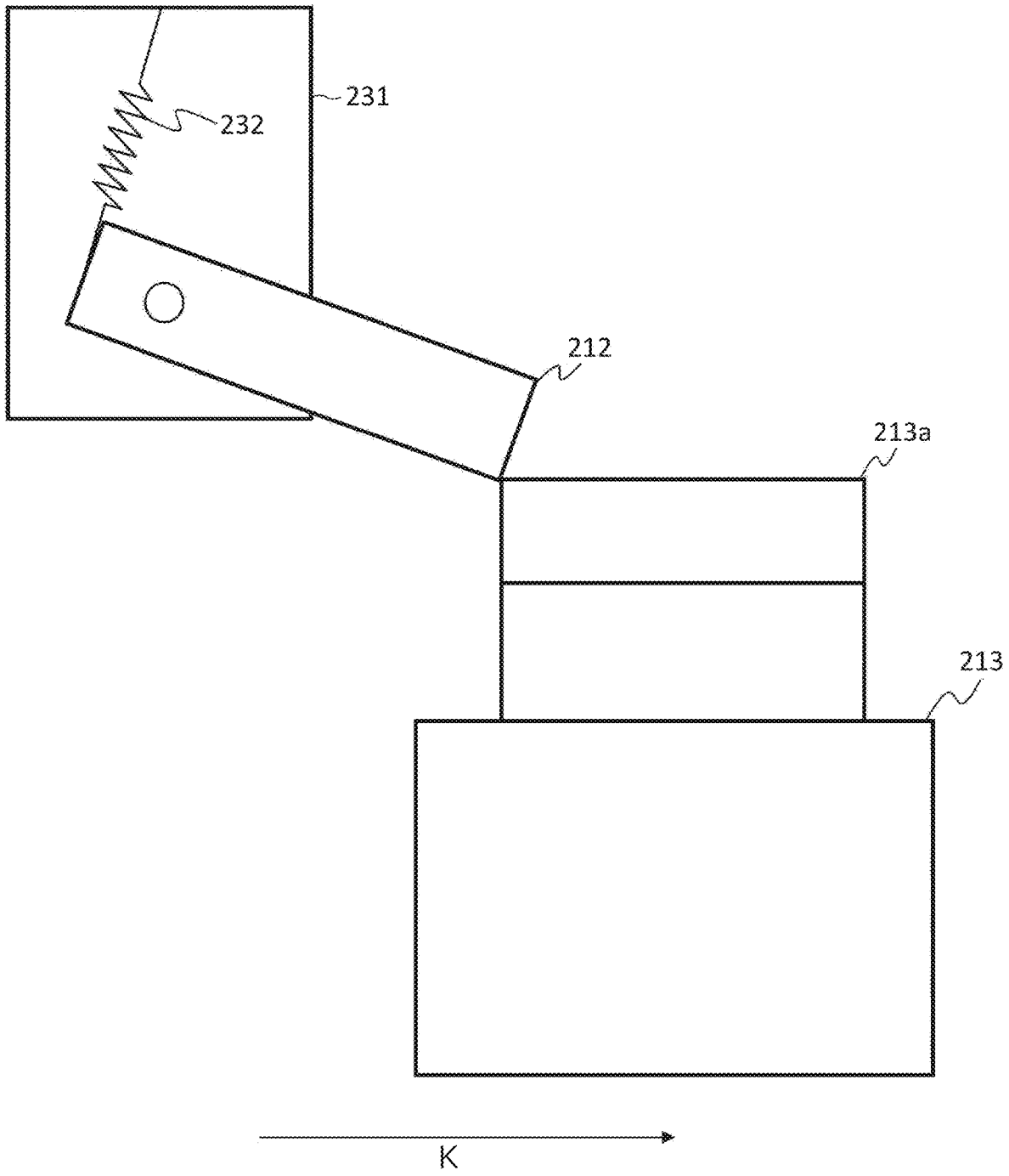
FIG. 23 is a side view illustrating another example of an interference avoidance operation in the interference avoidance mechanism.
Figure 24:
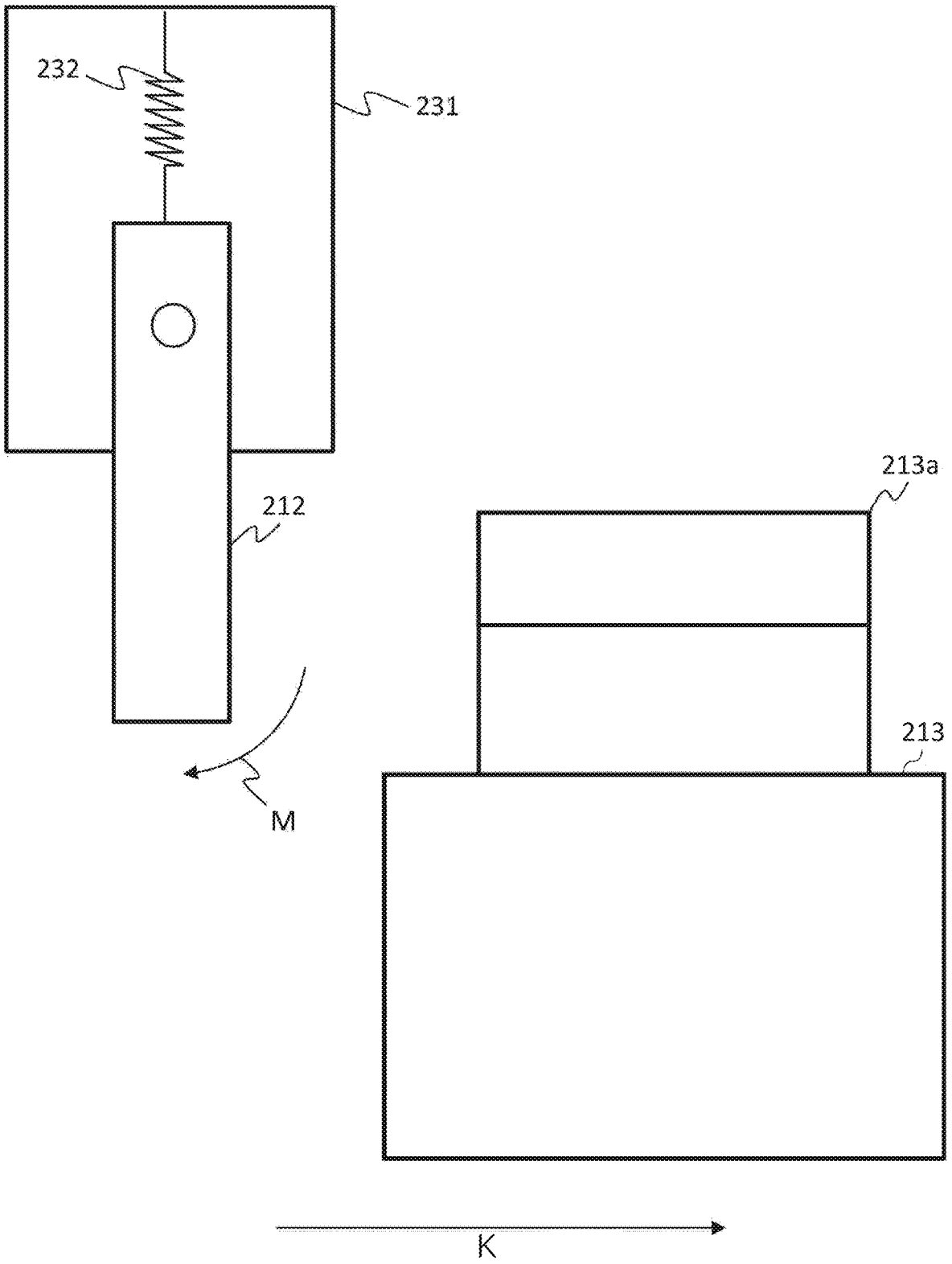
FIG. 24 is a side view illustrating another example of the interference avoidance operation in the interference avoidance mechanism.

After that, when the side stapler 213 is further moved in the direction of arrow K, the rear end pressing member 212, can be retreated from the range of movement of the movable portion 213*a*, to allow the side stapler 213 to move, as illustrated in FIG. 23, When the side stapler 213 is then moved further, the rear end pressing member 212 becomes free of interference with the movable portion 213*a*. Thus, the rear end pressing member 212 rotates in the direction of an arc M to return to the original position before the interference with the movable portion 213*a*, being pushed by the second tension spring 232, as illustrated in FIG. 24. This rotation in the direction of the arc M is caused by the second tension spring 232.

After that, when the rear end pressing member 212 returns to a position near the original position at which the rear end pressing member 212 does not interfere with the movable portion 213*a*, the second protruding portion 233*a* is engaged with the V-shaped groove 224*a* by the pushing force of the second compression spring 235, and the rotation is stopped in the restored state. Thus, the rear end pressing member 212 can automatically return to the original position.

Figure 25:
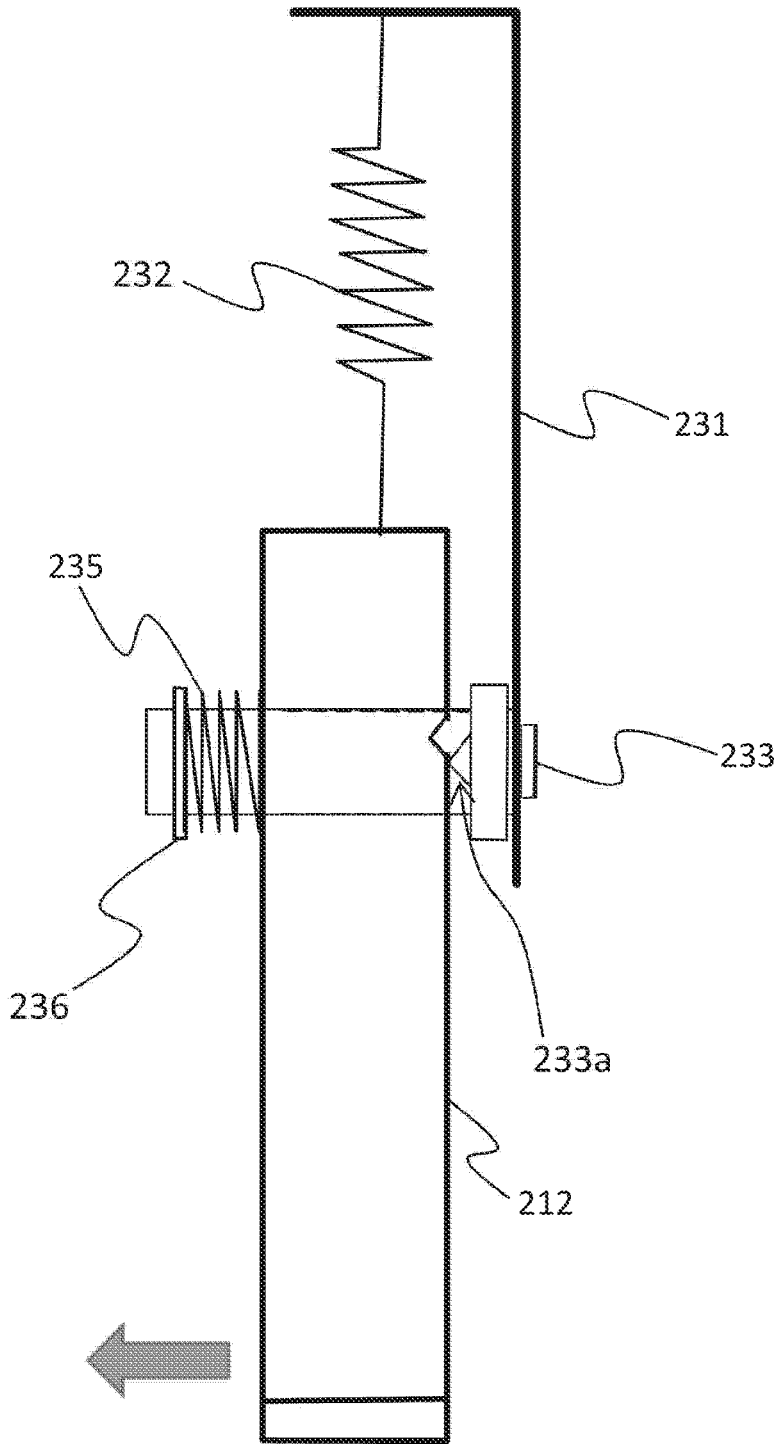
FIG. 25 is a front view illustrating a state of an interference avoidance operation in the interference avoidance mechanism.

FIG. 25 is a front view illustrating a state in which the rear end pressing member 212 has rotated, and the second protruding portion 233*a* is disengaged from the V-shaped groove 224*a*. As illustrated in FIG. 25, when a force exceeding the pushing force of the second compression spring 235 is applied to the engagement portion between the second protruding portion 233*a* and the V-shaped groove 224*a* due to the rotation of the rear end pressing member 212, the engagement is released, and the rear end pressing member 212 moves away from the second base 231, to rotate.

After that, when any force is no longer applied to the rear end pressing member 212 (when the collision with the side stapler 213 is resolved), the restoring force of the second tension spring 232 acts as a force in the direction in which rotation of the rear end pressing member 212 returns, After that, an engagement portion is again formed, and thus, the reference fence 211 returns to the original position.

As described above, the side binding device 200 according to the present embodiment is capable of moving a rear end pressing member 212, as an alignment device between an alignment position (operation position) that maintains moving up and down for a pressing operation, and a retreat position to which the rear end pressing member 212 is retreated from interference with the side stapler 213. This structure can avoid a failure due to interference between the side stapler 213 and the rear end pressing member 212 when the side stapler 213 malfunctions, or is forcibly moved by a user or a maintenance personnel. Further, after avoiding the failure due to interference, the reference fence 211 can be automatically returned to the alignment position.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A binding device comprising:

a stacking device configured to receive sheets;

a sheet alignment member configured to align the sheets on the stacking device;

a binder configured to bind the sheets on the stacking device;

a binder moving device configured to move the binder; and a retreat device configured to retreat the sheet alignment member from a range of movement of the binder in response to a pressing force acting on the sheet alignment member in a direction of movement of the binder, the retreat device including:

a retreat mechanism configured to retreat, from the range of movement of the binder, an interfering portion of the sheet alignment member in response to interference with the binder moved by the binder moving device; and a restoration mechanism configured to return the interfering portion of the sheet alignment member to a state before the interference, when the interference is resolved by the retreat mechanism, and wherein the retreat mechanism is configured to rotate the interfering portion of the sheet alignment member along the direction of movement of the binder in accordance with movement of the binder.

2. The binding device according to claim 1, wherein the restoration mechanism includes an elastic member configured to bias the interfering portion of the sheet alignment member in a direction against rotation of the interfering portion of the sheet alignment member along the direction of movement of the binder.

3. The binding device according to claim 1, wherein the retreat device includes a stopper configured to stop the interfering portion of the sheet alignment member in a state returned by the restoration mechanism, when the interfering portion is returned to the state before interference.

4. The binding device according to claim 1, wherein the sheet alignment member includes at least one of:

an end alignment member configured to align an end portion of the sheets; and an end press configured to press the end portion of the sheets in a direction of thickness of the sheets.

5. The binding device according to claim 1, wherein the binder is configured to bind the sheets in a state where an end portion of the sheets aligned by the sheet alignment member is pressed in a direction of thickness of the sheets.

6. A post-processing apparatus comprising the binding device according to claim 1.

7. An image forming system comprising:

an image forming apparatus configured to form an image on a sheet; and the post-processing apparatus according to claim 6, configured to receive the sheet from the image forming apparatus.

* * * * *